US005944311A

United States Patent [19]

Hartzell

[11] Patent Number: 5,944,311

[45] Date of Patent: Aug. 31, 1999

[54] SEQUENTIAL ATTITUDE-RESPONSIVE ENCLOSURE PUZZLE

[76] Inventor: Jonathan Hartzell, 11606 Fence Post Trail, Austin, Tex. 78750

[21] Appl. No.: 09/044,458

[22] Filed: Mar. 19, 1998

[51] Int. Cl.[6] ..... A63F 9/08

[52] U.S. Cl. ..... 273/156

[58] Field of Search ..... 273/156, 155, 273/153 R, 153 S

[56] References Cited

U.S. PATENT DOCUMENTS

| | | | |
|---|---|---|---|
| D. 280,430 | 9/1985 | Holman | 273/156 |
| 474,941 | 5/1892 | Bartholomew . | |
| 558,009 | 4/1896 | Worrall | 273/156 |
| 1,733,772 | 10/1929 | Battershell . | |
| 2,181,118 | 11/1939 | Boyle . | |
| 2,207,778 | 7/1940 | Boyle . | |
| 3,684,292 | 8/1972 | Penrod et al. . | |
| 3,695,617 | 10/1972 | Mogilner et al. . | |
| 4,376,537 | 3/1983 | Yokoi | 273/153 S |
| 4,625,968 | 12/1986 | McDermott . | |
| 5,411,262 | 5/1995 | Smith | 273/156 |
| 5,558,331 | 9/1996 | Zlotsky | 273/156 |

*Primary Examiner*—Steven Wong

[57] ABSTRACT

An enclosure puzzle whose preferred embodiment comprises a primary end cap (31) and a secondary end cap (32) rigidly mounted to face each other across a short distance. Spanning the distance are four rods (44, 45, 47 and 48), including two blocking rods (44 and 48), evenly spaced to form a cage, the rod ends penetrating the caps. Contained within the primary end cap are a primary pendulum (50) and tertiary pendulum (57). A secondary pendulum (52) is contained within the secondary end cap. To unlock the cage, one end of the release rod (45), is withdrawn from end cap (32) when the rod's other end is allowed full penetration of end cap (31). However, such penetration is normally blocked by tertiary pendulum (57). Therefore, release must be accomplished through a specific series of attitudinal orientations of the puzzle, causing primary and secondary pendulums (50) and (52) to align sequentially in such a way as to allow longitudinal shifting of the two blocking rods (44) and (48) to positions that ultimately allow tertiary pendulum (57) to rotate to an orientation that permits the release rod (45) to achieve maximum penetration of end cap (31). As a result the other end of the release rod can be withdrawn from end cap (32), thus allowing the rod to be angularly displaced in such a way as to provide a widened passage for the insertion or extraction of an object into or out of the cage.

5 Claims, 21 Drawing Sheets

37a
36a
35a 56
49
35b
36b
37b
33
52
44
55
53
34
45
54
50
56
31
32

SEQUENTIAL ATTITUDE-RESPONSIVE ENCLOSURE PUZZLE

BACKGROUND—FIELD OF INVENTION

The present invention relates to puzzles, and particularly to an enclosure puzzle in the form of a cage, which, despite its enticingly simple outer appearance, incorporates an elegant internal design that makes the puzzle's solution dependent on the execution of a specific sequence of attitudinal orientations.

BACKGROUND—PRIOR ART

In the wide-ranging field of amusement devices intended to challenge the mind, stimulate the intellect, and captivate the curiosity there appear to be two categories of puzzles that have maintained popularity for more than a century. The first of these categories would include what might be called "enclosure puzzles," those puzzles that challenge one to remove an object from an enclosure of some form. The second category would include puzzles of the "take-apart" kind, wherein one is challenged to disassemble the puzzle.

Two examples of the "take-apart" puzzle having relevance here are presented by J. D. Boyle in patents issued Nov. 28th, 1939 and Jul. 16th, 1940. In the first of these, U.S. Pat. No. 2,181,118, Boyle's puzzle has four rectangular blocks fitted against a crossbar composed of two members having interlocked notches at their midpoints. The assembly is held together by a locking arrangement employing four sliding pins residing in hidden channels within the puzzle. Disassembly requires a series of bodily rotations of the puzzle to allow the pins to fall into a configuration that partially frees one of the four blocks. That particular key block must then be twisted about one of the pins with sufficient force to dislodge one of the notched crossbar members. Such having been accomplished, the blocks can then be forced apart one by one.

Boyle's puzzle serves as an early example of the use of attitudinal orientation as a factor in a puzzle's operation. Unfortunately, the range of attitudes in which the body of the puzzle can be positioned to achieve the desired shifting of the pins is rather wide and non-specific; for example, to get the first pin to move in the proper direction, it is only necessary to tilt the puzzle so that one end of the pin's channel is oriented generally downward with respect to gravity, such that a variance of as much as forty-five degrees from plumb will still result in an overall downward motion of the pin. Furthermore, the last four attitudinal positionings required for solving the puzzle, though intended to be incremental, can all be executed by simply turning the puzzle through one complete rotation, making it very possible for the proper pin dispositions to be achieved by accident. In a further refinement the inventor suggests the incorporation of another sliding pin within the crossbar assembly itself. Although this, too, can be defeated by tilting the puzzle to any number of attitudes that will result in an overall downward movement of the pin, it at least adds another step into the series of movements that lead to the puzzle's solution.

It is important to note that, although a portion of the puzzle's operation depends on gravity to move the pins, the remainder of the puzzle's actual solution relies on the use of force involved in the twisting, manipulation and, in the case of the second embodiment, the repeated twisting of the key block, which "bit by bit" will rotate the first pin until there is sufficient clearance created to finally allow the pieces to be twisted and pulled apart.

In U.S. Pat. No. 2,207,778 Boyle presents another puzzle that serves as both a "take-apart" and "enclosure" puzzle" in one. This puzzle features three thick discs clustered together about a three-armed retainer. Each disc has two bore holes beginning on the outside and converging within, such that each disc is joined to its neighbor by way of a shared rod passing through a hole at the end of one of the retainer arms and extending into the interiors of the two discs by way of the bores. The rods, themselves, are of differing lengths, one being considerably shorter than the others, so that when its one end is successfully moved deeper into the bore of one disc, its other end pulls free of the bore entry of an adjoining disc, thereby allowing further disassembly of the puzzle. But before such an event can happen, the other two rods must first be moved and shifted within the other disc bores. In a manner reminiscent of Boyle's earlier puzzle, the first disc must be twisted repetitively and forcibly about the first rod, almost in a kneading fashion, to cause the rod to gradually rotate into a position whereby a notch at one end of the rod aligns in such a way as to allow deeper penetration of a second rod into the convergence of the disc bores. As the puzzle is tilted in the general orientation that allows the end of the second rod to slip deeper into the disc, the rod's other end retracts from, or vacates, the bore convergence area of the other, or second, disc to which it is connected. This in turn allows the third and shortest rod to be slid so that one end moves all the way into the vacated bore convergence of the second disc, its other end having pulled clear of the third disc's bore entrance. This having been accomplished, the puzzle can now be pulled apart, piece by piece. In a further refinement of the puzzle Boyle includes an open slot in the edge of the third disc. A small object or token can be held in the slot so that, when the puzzle is intact, the object is kept from falling out by the barricading effect of the nearby facing surface of the retainer. Although the slot appears to have been merely the result of an afterthought by the inventor, it nevertheless adds to the arrangement an "enclosure" puzzle aspect that is at least worthy of mention.

Both puzzles by Boyle serve as examples of the use of a classic concept wherein a pin, rod, or tumbler of some variety pulls clear of another member of a mechanism, thereby freeing some other component or enabling another portion of the mechanism to operate. Typically in such applications of the concept the pins, rods or tumblers, if not completely hidden from view, are at least concealed to the extent that only a small portion of them can be seen. This is not only true in regard to Boyle's puzzles, but also pertains to security devices such keyed locks, combination locks and hundreds of other similar mechanisms.

In both of his inventions Boyle uses a notched or beveled rod that must be forcibly twisted so that it rotates to a disposition in which the notch or bevel can accept entry of the end of another rod to bring about the operation of his device. On the other hand, because of the nature of the puzzles, the concept of attitude sensitivity can only be partially employed, and only in a relatively crude manner.

In a discussion of relevant prior art attention should also be given to another device that relates to enclosure puzzles, namely the gravity control lock presented by C. F. Battershell in U.S. Pat. No. 1,733,772 issued Oct. 29th, 1929. Because the invention is presented as it would be employed in conjunction with a so-called mystery box, it can also be considered to relate to a type of enclosure puzzle. The operating mechanism, housed within the lid of the box, is based on a long bolt, or rod, which can slide longitudinally within a channel so as to engage a locking hasp secured to the front of the box. The freedom of movement of the long rod is governed by the dispositions of two sliding "keepers" that are located in channels at right angles to the rod. The keepers, themselves being rods of a shorter length, can block motion of the long rod by moving into its path. The keepers can also be restricted in regard to their own longitudinal motion by ball obstructions located within recesses near their outermost ends. This combination is such that the entire box must be tilted in a sequence of orientations with respect to gravity, causing the obstruction balls to move out of the way of the keepers, in turn allowing the keepers to slide out of the path of the long rod, so that the rod will retract from the locking hasp of the box.

Battershell's device is another example in which the required attitudinal orientations can vary within a wide range and still cause lock release. It is also typical of many other enclosures having a locking device whose sliding rods are concealed from view, and wherein the object being contained is not visible to one who would extract or retrieve it. For this reason the invention, although worthy as device used in conjunction with a box intended for the purpose of securing private papers, keepsakes and the like, would not serve well as an enticing puzzle. In other words it can be said that, unless one were informed that the device at hand was indeed a puzzle, one would not readily recognize it as such and would not therefore be enticed by its appearance to attempt to solve it.

Another invention having a similar drawback is that presented in U.S. Pat. No. 474,941 issued May 17th, 1892 to A. W. Bartholomew. Here is an enclosure device that can also go easily unrecognized as a puzzle. Again, its operative sliding rod is concealed within and, like many other puzzles of this kind, the object to be removed is also hidden from view within its confines, such that there is no outward appearance signaling that it is in fact a puzzle to be solved. The device does, however, merit consideration by virtue of the fact that it utilizes a rotatable disc with a hole that can come into alignment with the rod when the disc has been turned to a specific rotational position and pushed sideways, thereby allowing the rod to slide through the disc's hole and deeper into a channel, such that the rod's other end retracts from a socket located in the lid of the enclosure. This having been accomplished, the lid can be swiveled to one side, exposing the interior chamber of the device. A rotatable disc with a registering hole or slot has the advantage of providing a continuously repeating range of angular or positional possibilities with the potential for precise selectivity of any particular possibility within that range. The puzzle's mechanism is also responsive to attitudinal orientation, but in a crude way, much like the previous examples above, in that the device needs only to be inverted or upright to effect the required movements of the rod and the two balls that are also used in the mechanism inside. As with Boyle's devices discussed earlier, the puzzle's solution involves the use of force and physical manipulation in first rotating the disc, and then shoving it laterally into a position that causes registration of the sliding rod with one of the disc's holes.

A novel and refreshing departure is made from the long-established lineup of enclosure puzzles in U.S. Pat. No. 3,695,617 issued Oct. 3rd, 1972, in which Mogilner et al present their tensegrity structure puzzle. Here is a puzzle whose object contained within is readily visible, being enclosed within a conglomeration of dowel-like rods held together by cord segments running through notches in the rod ends. A good deal of the merit of this puzzle lies in the fact that not only is the contained object plainly visible, but also the entire structure of the puzzle enclosure itself is easily seen. It is certainly a fine puzzle whose polyhedral theme should be highly appreciated by those who enjoy physics, geometry and mathematics. However, its appearance can nevertheless be daunting to one who is not conversant with such disciplines. Looking at the puzzle, one is not only confronted with twelve rods disposed at differing angles and relations to one another, but also potentially confused by the plurality of tension members joining the various rod ends and thereby assuming their own additional angular and positional relationships. In fact, there may be some who, if not intimidated or overwhelmed by the device's apparent complexity, might nevertheless find themselves reluctant to move even one of the rods for fear of causing further entanglement of the puzzle's components.

There are yet two other puzzles having relevance in the present discussion of prior art, each involving the withdrawal of a captive object:

U.S. Pat. No. 3,684,292, issued Aug. 15, 1972 to Penrod et al, presents a puzzle having an outer body fashioned to resemble a stone and penetrated by a rod-like member resembling a sword, the goal being the removal of the sword from the stone. Here is a puzzle whose outward appearance of simplicity can be irresistibly enticing to the passer-by who, seeing nothing more than the hilt and handle of a sword protruding from a stone, is immediately obliged to withdraw the weapon, certainly a response most natural. In this puzzle only a portion of the object to be removed is visible, mainly the handle, with the remainder, the blade itself, being hidden from view and acted upon by a locking mechanism within the main body. In its simplest form the mechanism has a tooth that engages a notch in the upper edge of the blade. The inventors, however, offer modifications that lend a certain complexity to the internal mechanism with the intention of preventing easy or accidental release. Using vertically sliding ferrous bars with teeth at their ends for engaging slots on the blade, the puzzle takes on a crude form of attitude responsiveness, which is enhanced somewhat by the addition of a simple pendulum for blocking or permitting the downward flex of a leaf spring. There is a further complexity in the modification which involves the use of a magnet applied to the exterior of the puzzle's body, while inverted, for the purpose of keeping one of the ferrous bars from sliding into a locking position when the body is turned upright once again. However, many purists will agree that a puzzle requiring the use of a special or secret tool for its solution violates customary ethics, for it is generally understood that the only key to a worthy puzzle is one's imagination and intellect.

U.S. Pat. No. 4,625,968, issued Dec. 2nd 1986 to Brian L. McDermott, presents an enclosure puzzle wherein the object to be removed, a ball, is readily seen. The ball is enclosed within a cage having four vertical rods whose upper and lower ends terminate respectively in top and bottom caps. Three of the rods are inert, or passive, meaning that they serve no function in respect to the release mechanism. One of the rods, however, is of the classic sliding release rod type, being somewhat shorter than the others, so that, when one end is allowed full penetration into one cap, its other end pulls clear of the other cap. The loosened end of the rod can then be moved aside, permitting the ball's exit. Hidden within the top cap is a channel containing a sliding rod of ferrous composition. Communicating with the channel perpendicularly is a second channel containing a sliding magnet. The ferrous rod and magnet, having mutual attraction, share communion at the juncture of the two channels in such a way as to block the full upward penetration of the release rod into the cap. Solving the puzzle involves unlocking the magnetic latch by striking the puzzle with sufficient force and in a general direction that will dislodge the magnet from the ferrous rod, then tipping the puzzle so the ferrous rod will slide out of the way of the release rod, thereby allowing the release rod to pull clear of the bottom cap.

Unfortunately, the device is exceptionally vulnerable to accidental release. A single tap of moderate force not only dislodges the magnet, but also in many instances frees the release rod as well, contrary to the inventor's intention. Although the perpendicular arrangement of the ferrous rod and magnet was designed to make the mechanism responsive to a striking blow from one general direction, such as in the typical motion of slapping the puzzle endwise into the palm of the hand, even the subtle rebounding motion of the hand is sufficient to free the release rod. Another example of the puzzle's vulnerability comes by way of an incident in which a child, bringing a toy magnet into contact with the upper cap, unintentionally caused the ball's release.

SUMMARY OF PRIOR ART

All the examples of prior art cited above have certain features or attributes that not only attest to their worthiness as inventions, but also relate strongly with the invention about to be described. On the other hand, it is also true that each of the above examples either lacks certain features, attributes or advantages considered desirable, or includes at least one disadvantage or undesirable characteristic as seen in the light of the present invention.

OBJECTS AND ADVANTAGES

The present invention, a cage-like enclosure puzzle responsive only to a specific sequence of positional attitudes, is designed to accomplish the following objects and achieve the related advantages that result:

A. To provide a cage puzzle of notable internal sophistication, yet whose outward appearance is remarkably simple, with the resultant advantage that, rather than appearing intimidating, daunting, or overwhelming in complexity, the puzzle will instead be seen as attractive and enticing to the curiosity.

B. To provide a cage puzzle whose solution will neither be discovered easily nor by accident, the resultant advantage being that the puzzle will maintain its aspects of challenge and intrigue for a considerable time.

C. To provide a cage puzzle whose multiple step solution, once known, can be executed easily and within a time duration of less than five seconds, the advantage being that the puzzle can be demonstrated before onlookers in such a way as to not only heighten existing senses of curiosity, mystery and wonder, but also to prove beyond doubt that the puzzle can indeed be solved.

D. To provide a cage puzzle whose solution requires neither forceful manipulation nor striking, with the result that the puzzle's degree of mystery and intrigue is even further enhanced.

E. To provide a cage puzzle whose function is neither reliant upon nor vulnerable to any magnetic influence, whether of internal or external origin, the advantage being that the puzzle can be constructed of virtually any solid material, some examples of which not only include woods, plastics and ceramics, but also both ferrous and non-ferrous metals.

F. To provide a cage puzzle whose mechanism is both reliable and consistent in its operation, with the resultant advantage that the puzzle can be locked and unlocked smoothly and effortlessly and without embarrassing or awkward malfunctions when being demonstrated before onlookers.

G. To provide a cage puzzle that allows an enclosed object to be plainly and easily visible, thereby generating increased curiosity and a heightened desire on the part of the aspiring solver to remove such an object.

H. To provide a cage puzzle whose operative rods are all visible and directly moveable by hand, thereby giving the aspiring solver a greater sense of participation and control.

I. To provide a cage puzzle that maximizes the functionality of the enclosing rods, causing them to serve not only their obvious function of restricting the passage of an object between them, but also the less obvious function of acting as elements in the keying process that ultimately releases such restriction. The advantage of such dual function is that of providing, without the addition of complexity to its outward appearance, a puzzle of hidden elegance and sophistication which promises to present a formidable challenge to anyone who would endeavor to discover its solution.

Note:

For the purpose of clarity in presenting the internal features of the puzzle, all subsequent drawings described as "close proximity" will depict the inner and outer layers of the end caps in wireframe style to achieve transparency.

Figure 7:
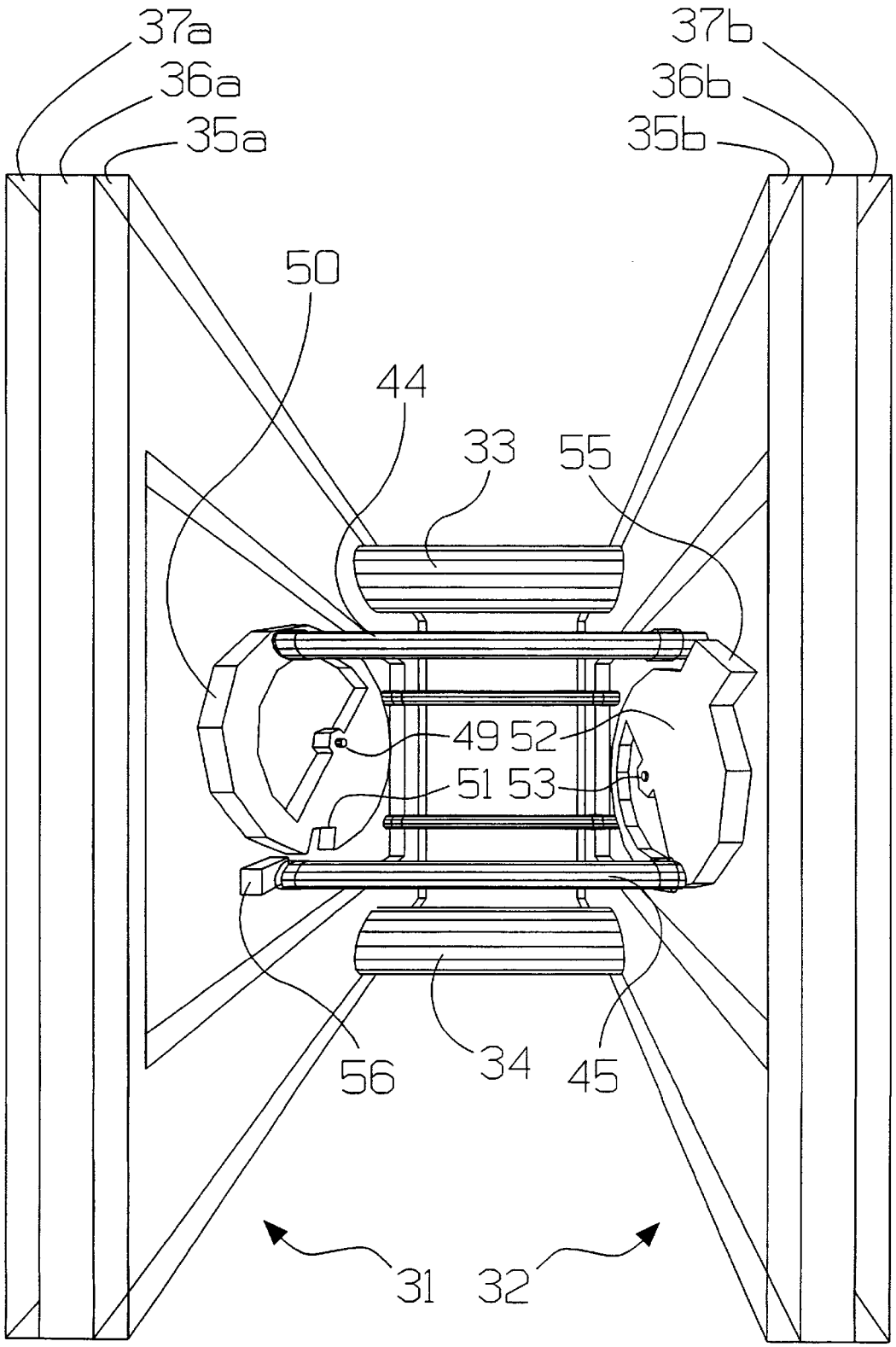

FIG. 7 is a close proximity internal perspective view of the first embodiment in its locked configuration.

Figure 8:
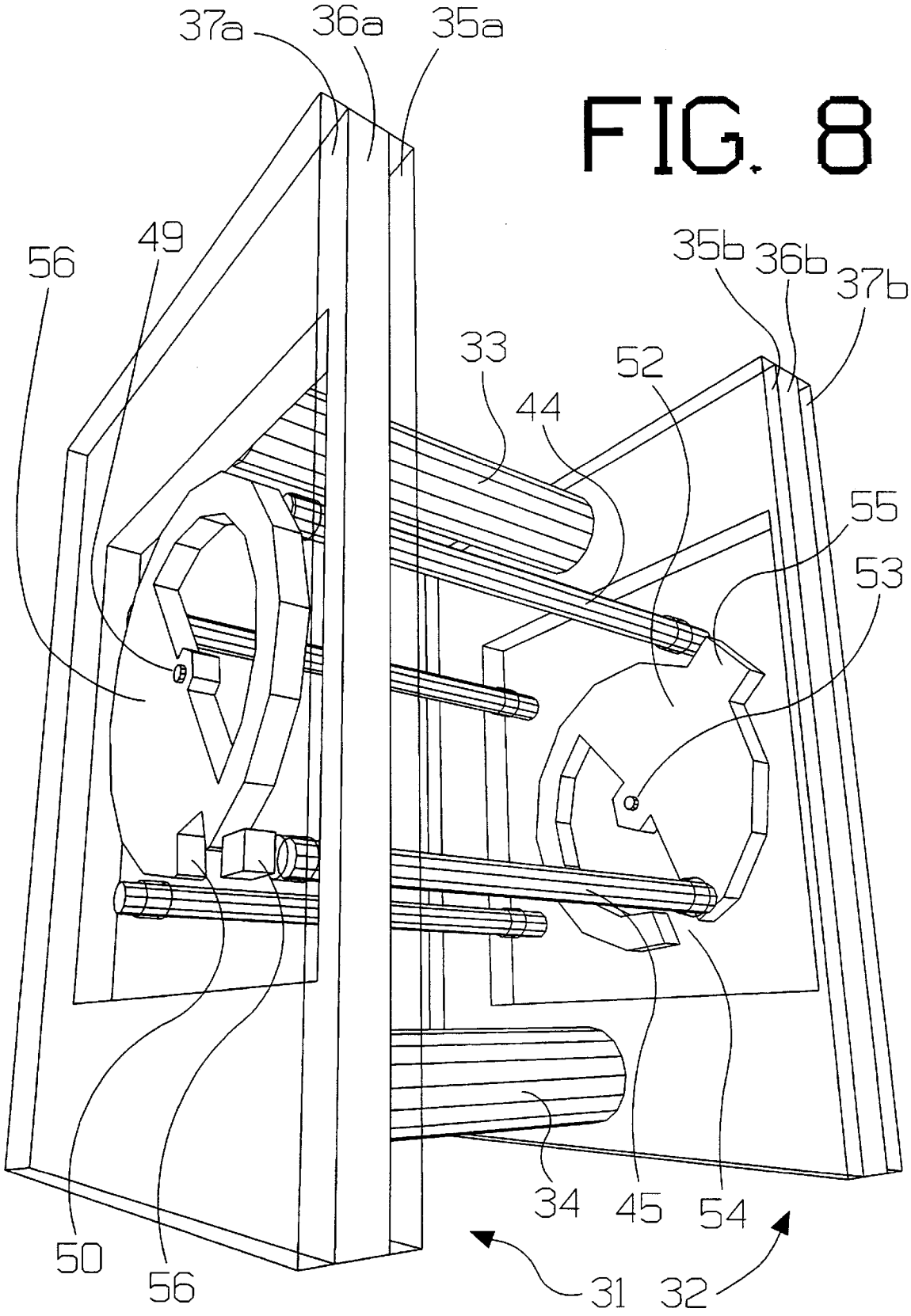

FIG. 8 is a close proximity external perspective view of the first embodiment in its locked configuration.

Figure 9:
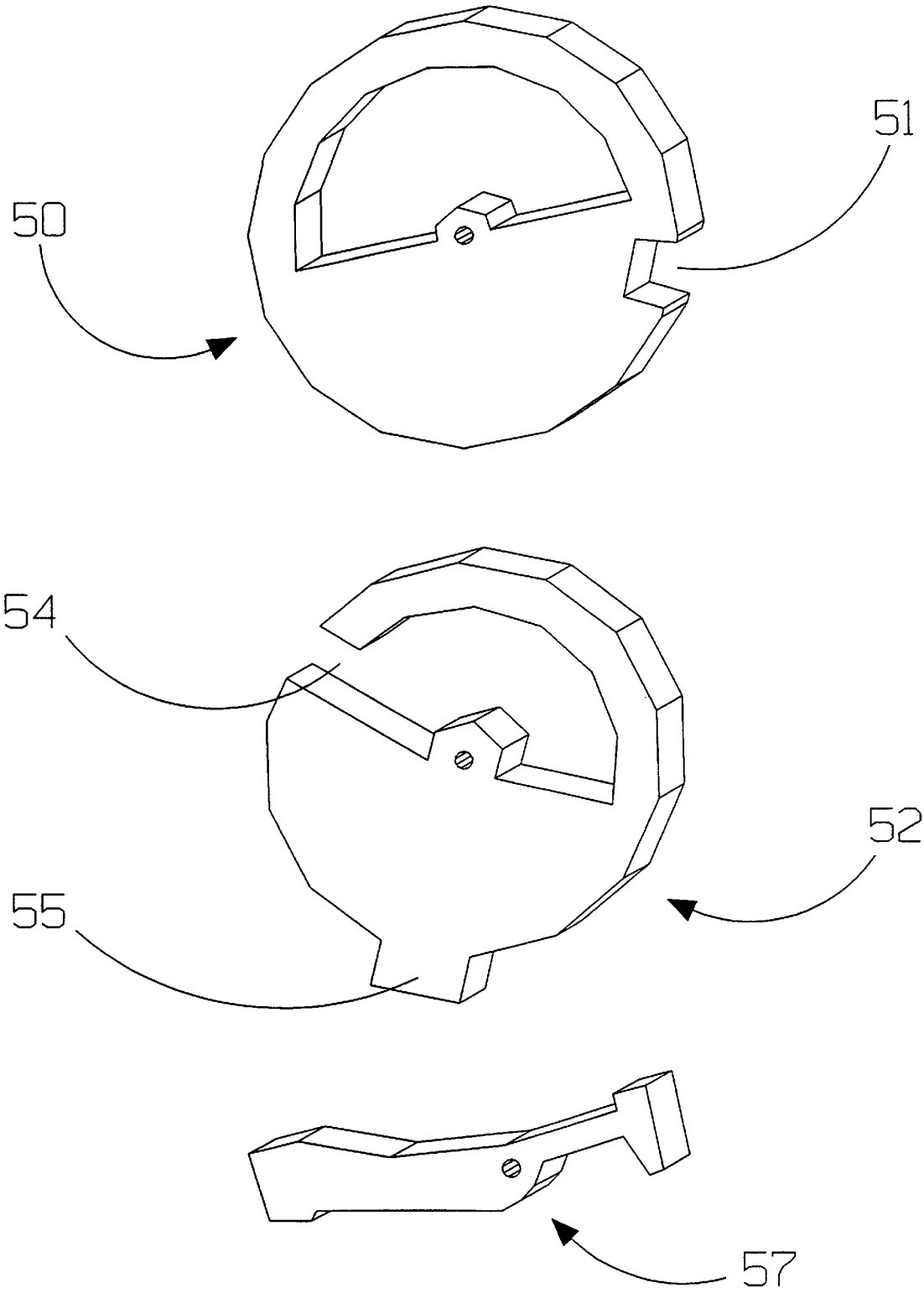

FIG. 9 is a perspective view showing the primary and secondary pendulums of the first embodiment, as well as the tertiary pendulum of the preferred embodiment.

Figure 10:
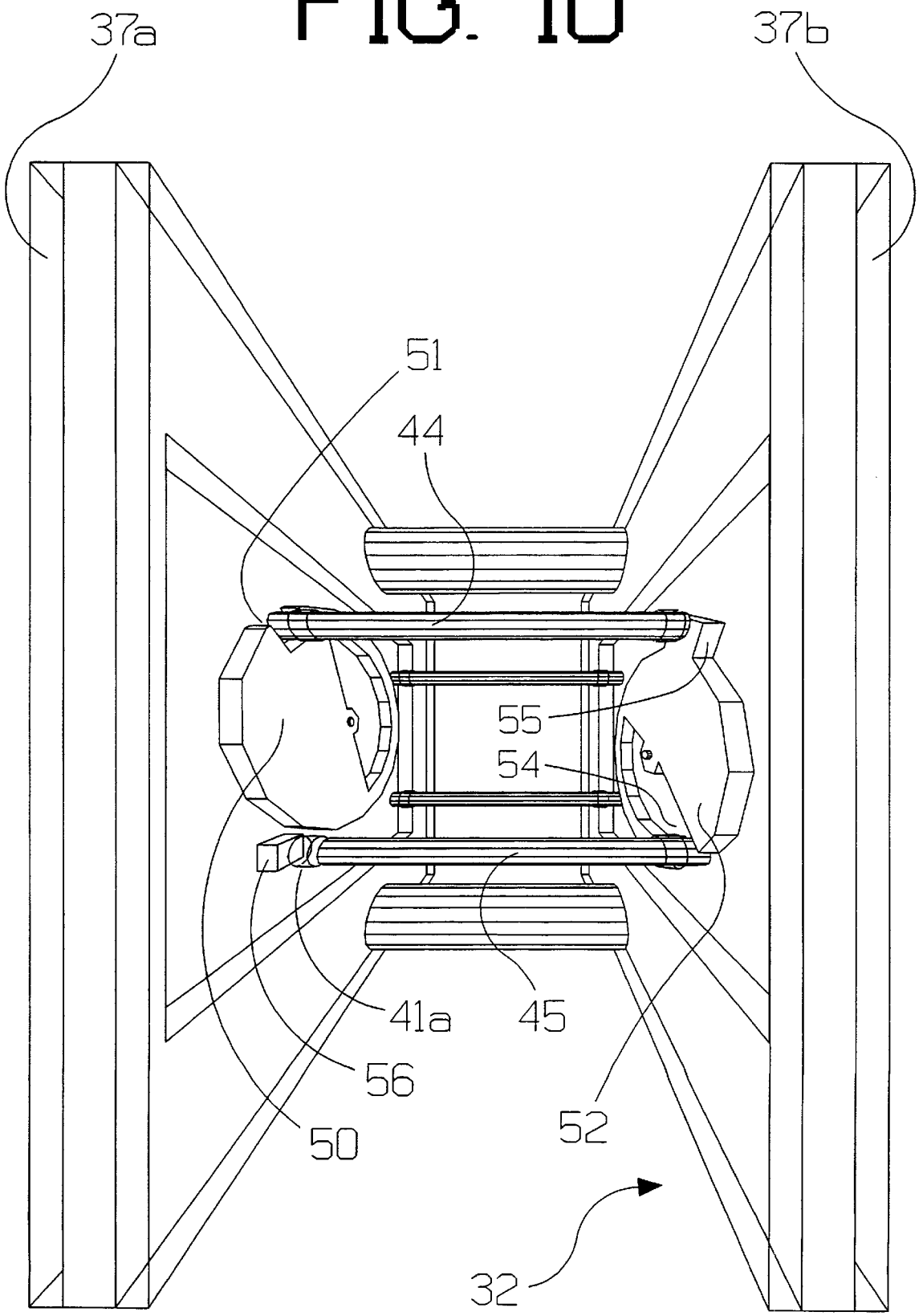

FIG. 10 is a close proximity internal perspective view of the first embodiment in its released configuration.

Figure 11:
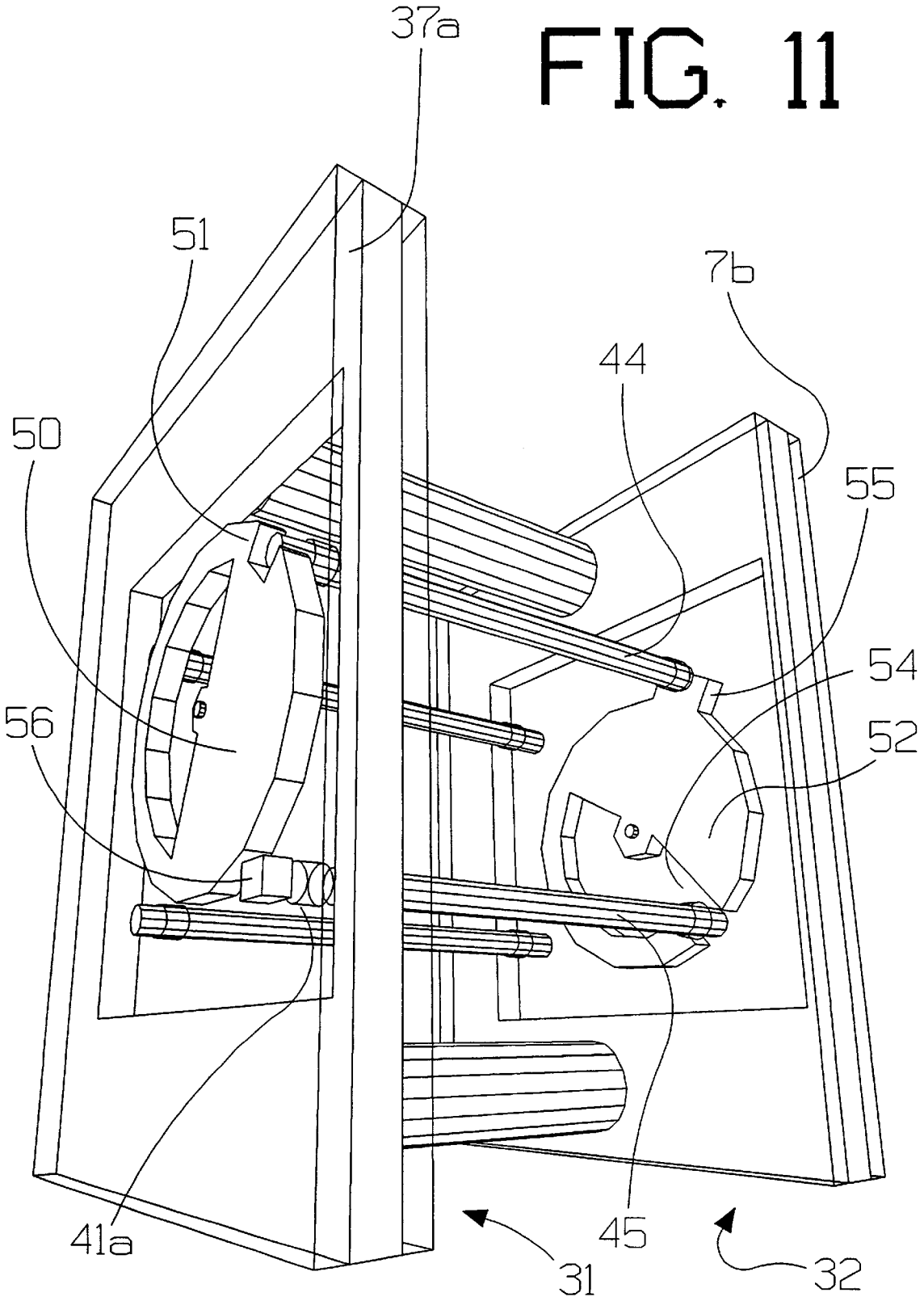

FIG. 11 is a close proximity external perspective view of the first embodiment in its released configuration.

Figure 12:
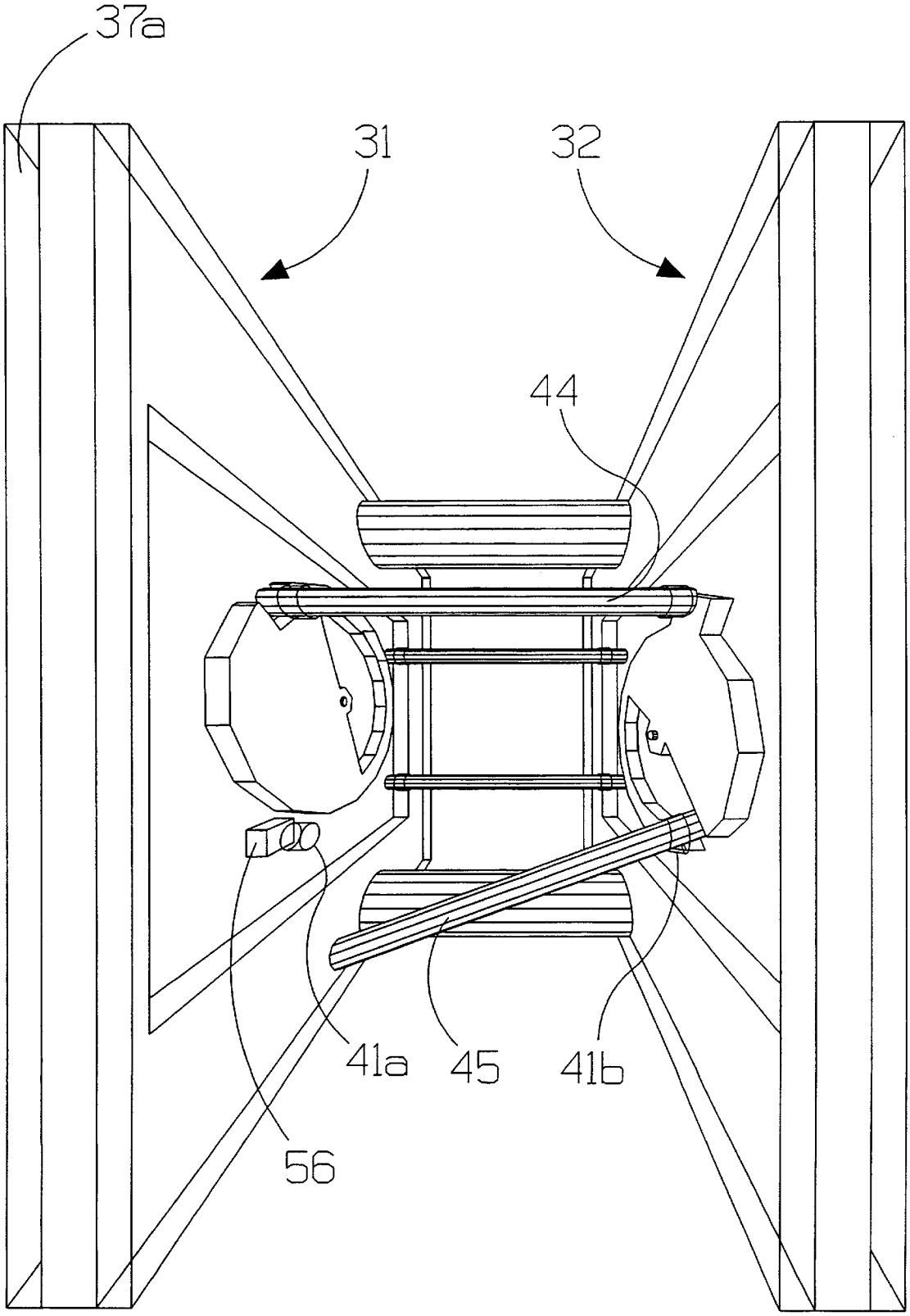

FIG. 12 is a close proximity internal perspective view of the first embodiment, showing angular displacement of the release rod.

Figure 13:
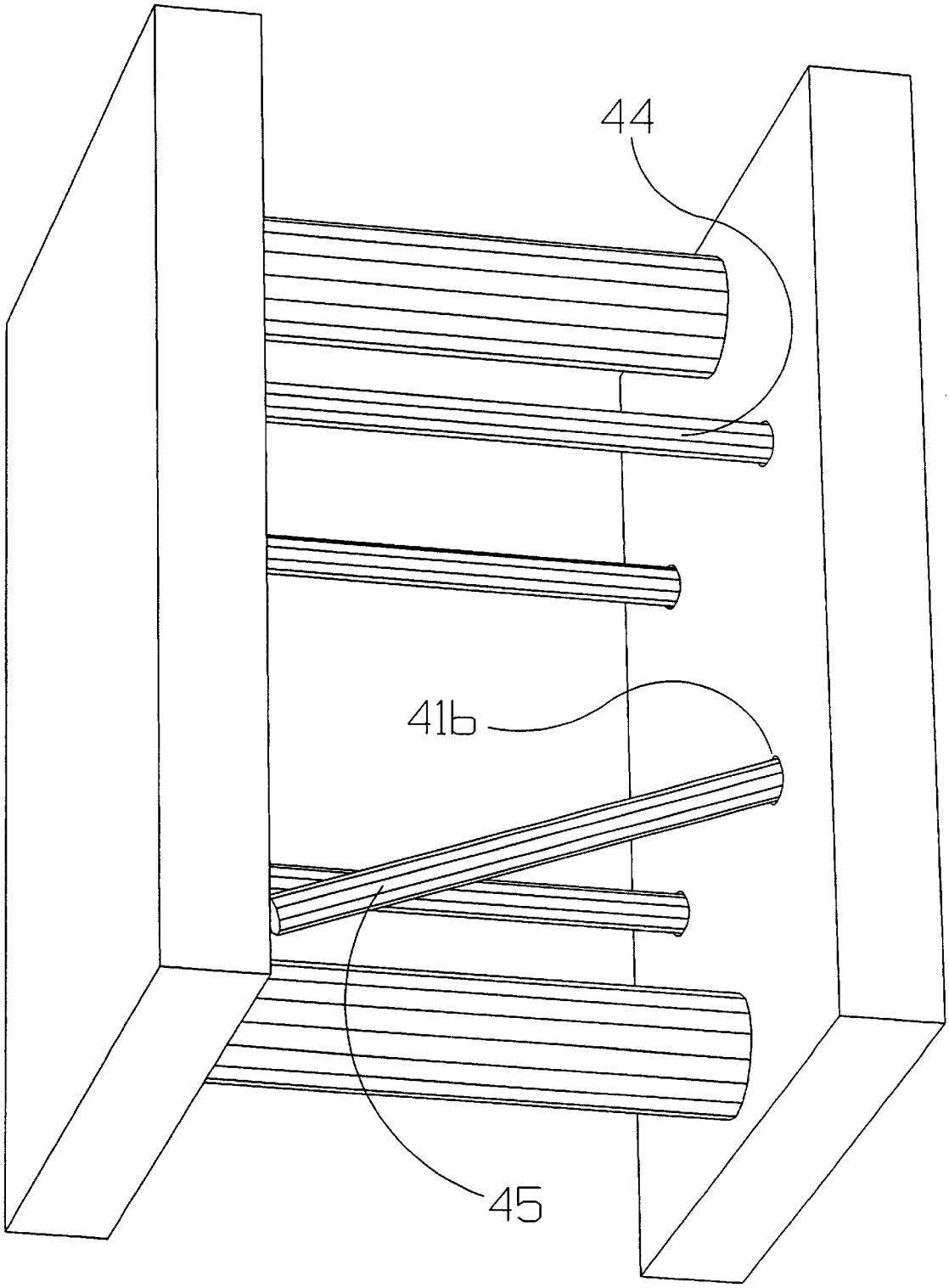

FIG. 13 is an external perspective view of the puzzle as it actually appears when its release rod is displaced.

Figure 14:
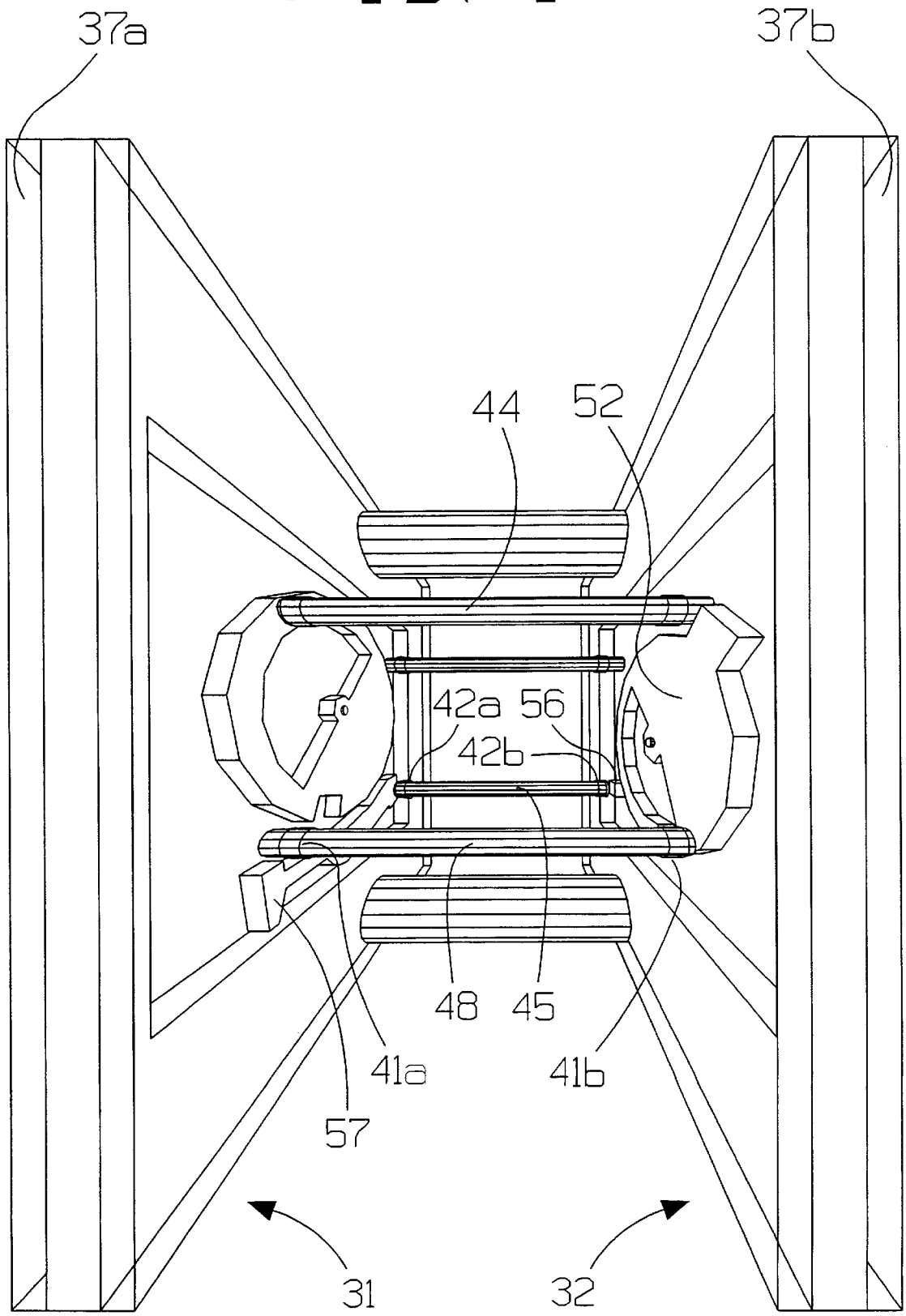

FIG. 14 is a close proximity internal perspective view of the preferred embodiment in its locked configuration.

Figure 15:
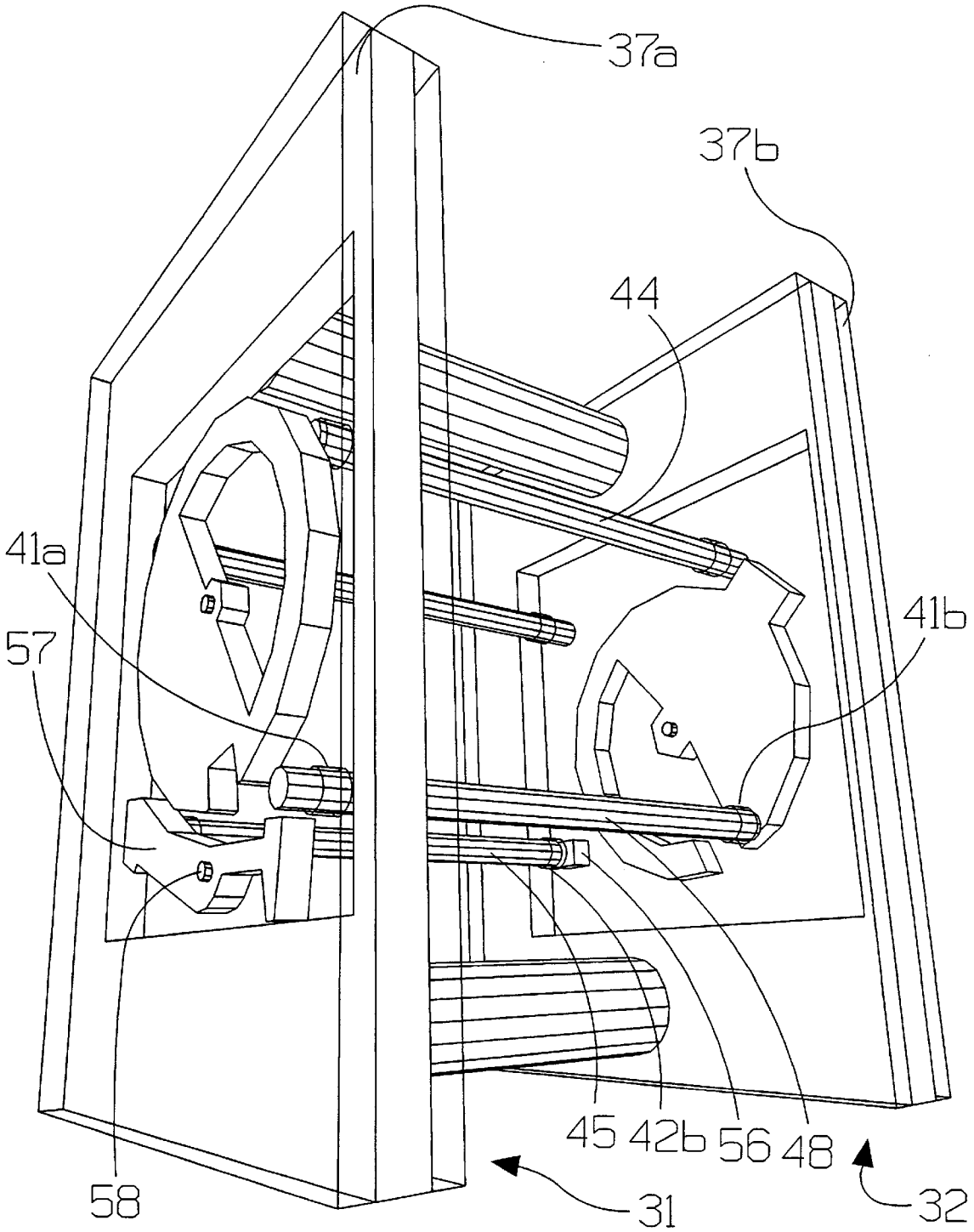

FIG. 15 is a close proximity external perspective view of the preferred embodiment in its locked configuration.

Figure 16:
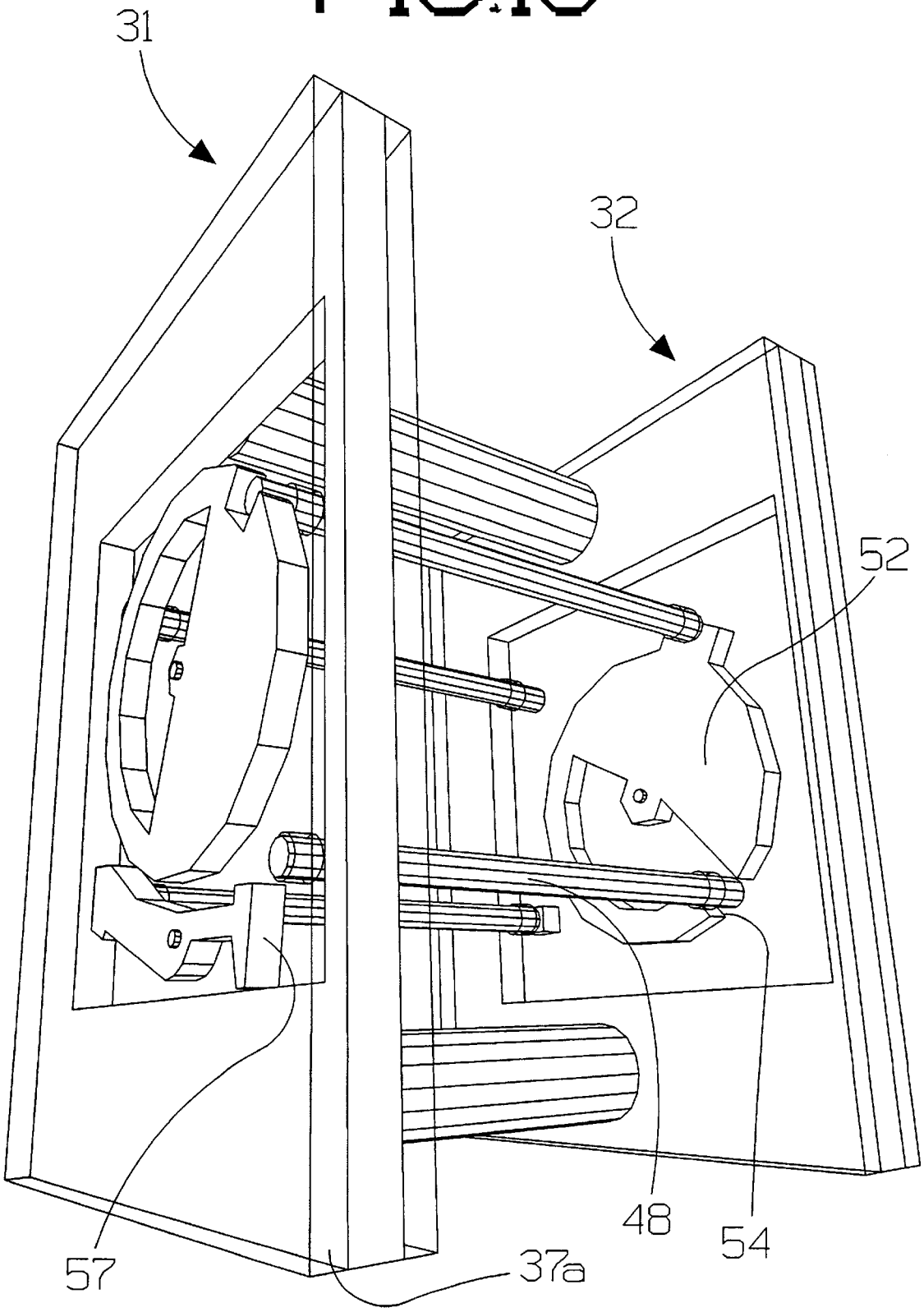

FIG. 16 is a close proximity external perspective view of the preferred embodiment with blocking rod 48 disposed to allow rotation of the tertiary pendulum.

Figure 17:
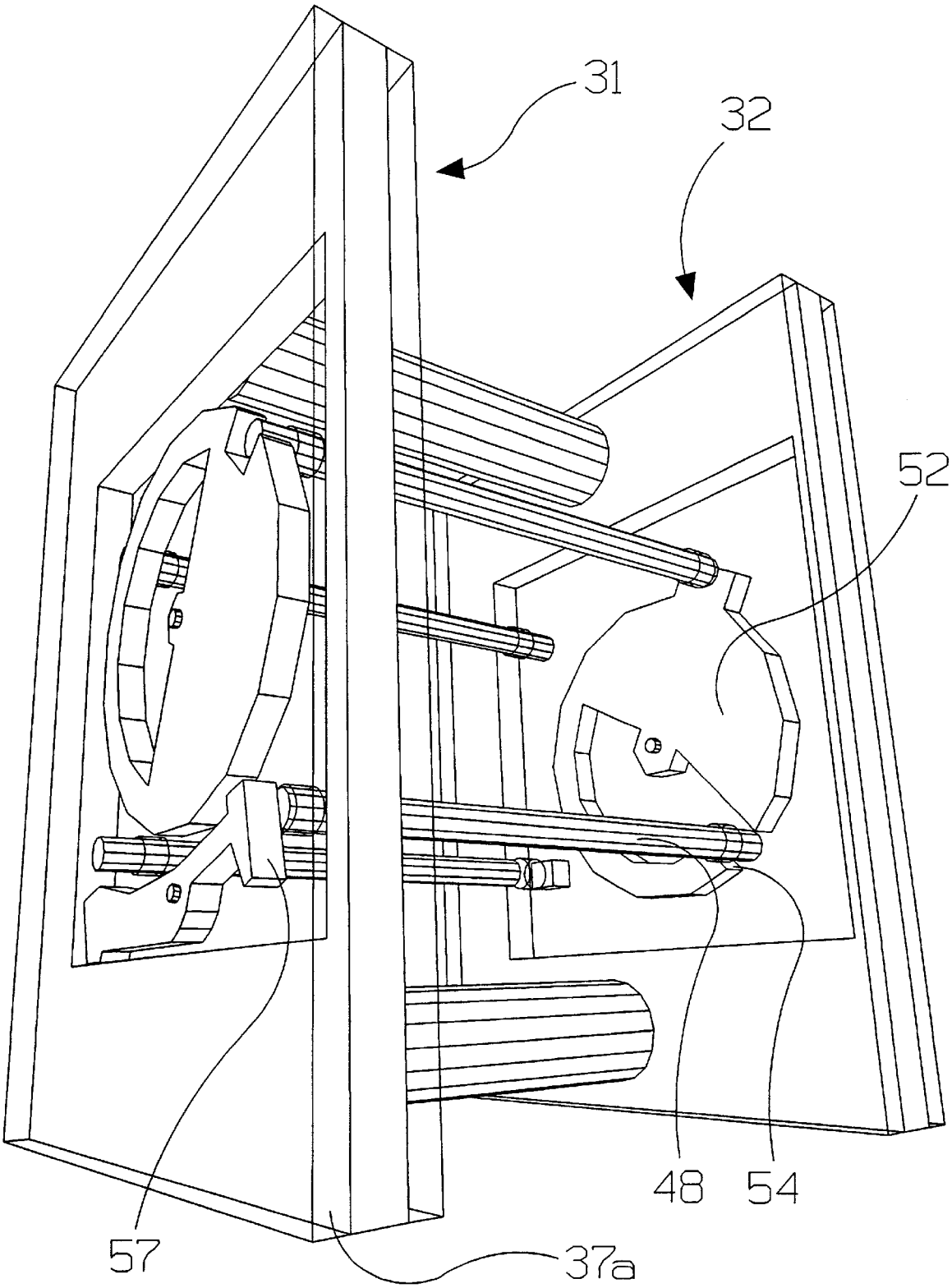

FIG. 17 is a close proximity external perspective view of the preferred embodiment with the tertiary pendulum rotated to its releasing position.

Figure 18:
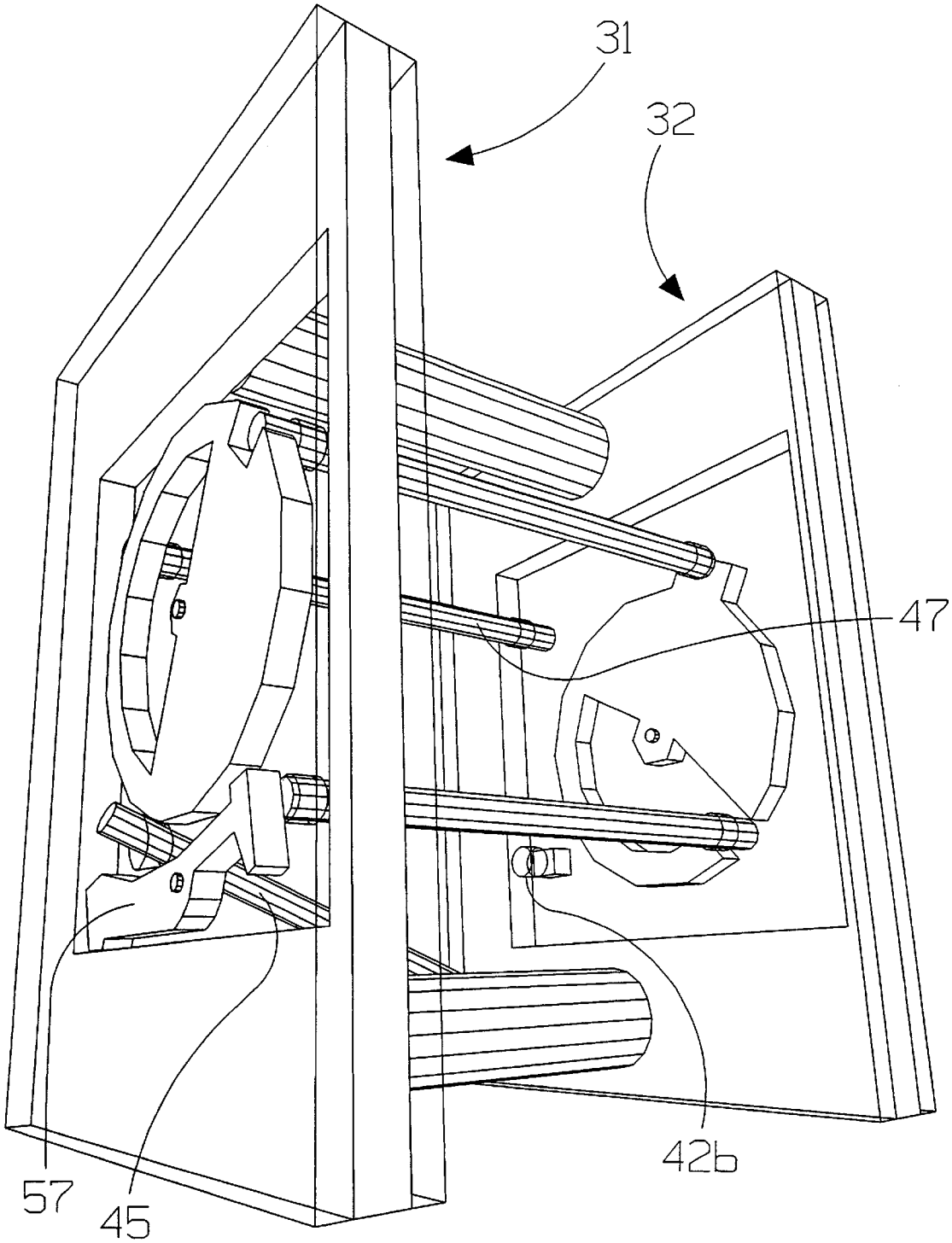

FIG. 18 is a close proximity external perspective view of the preferred embodiment with the release rod having been angularly displaced.

Figure 19:
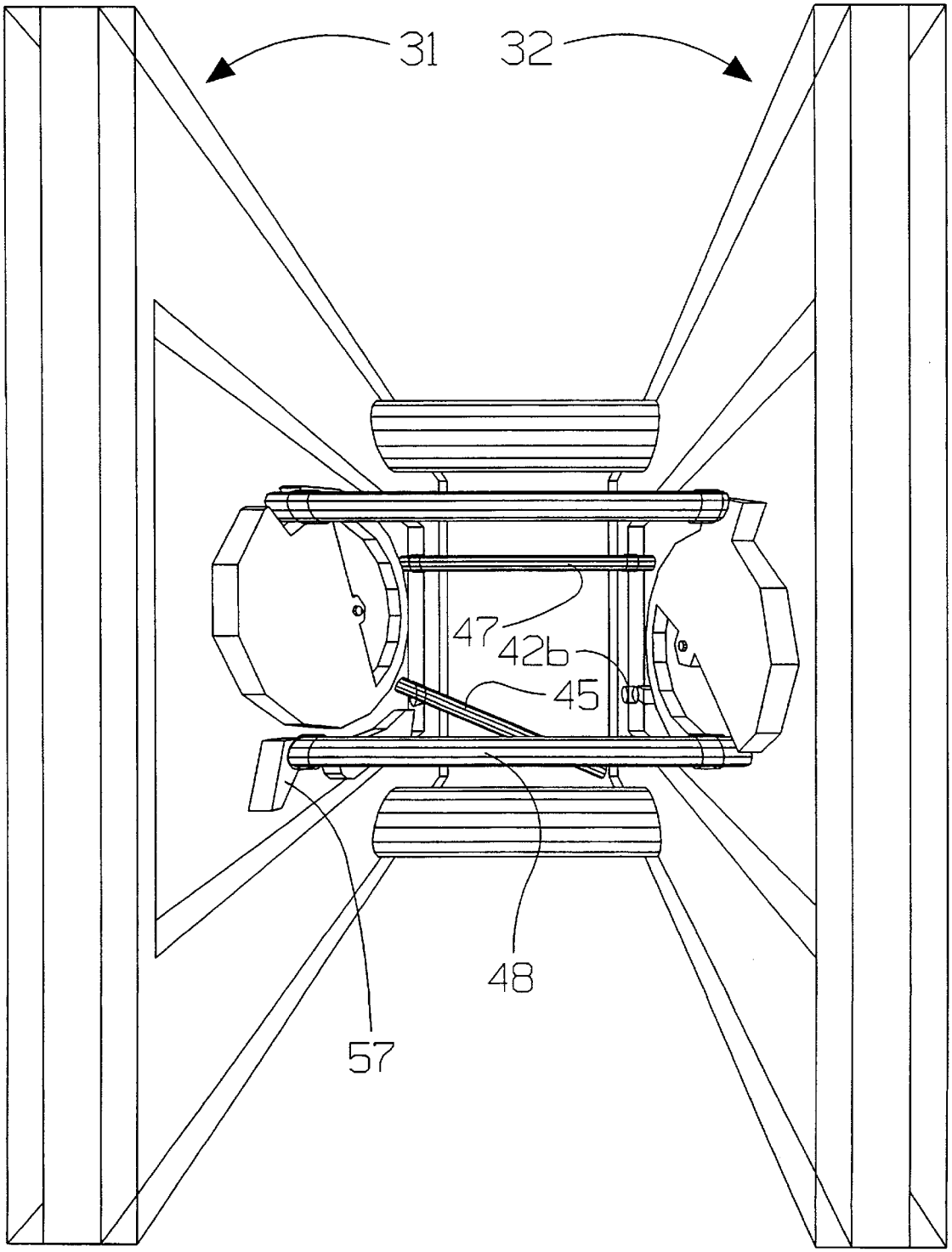

FIG. 19 is a close proximity internal perspective view of the preferred embodiment with the release rod having been angularly displaced.

Figure 20A:
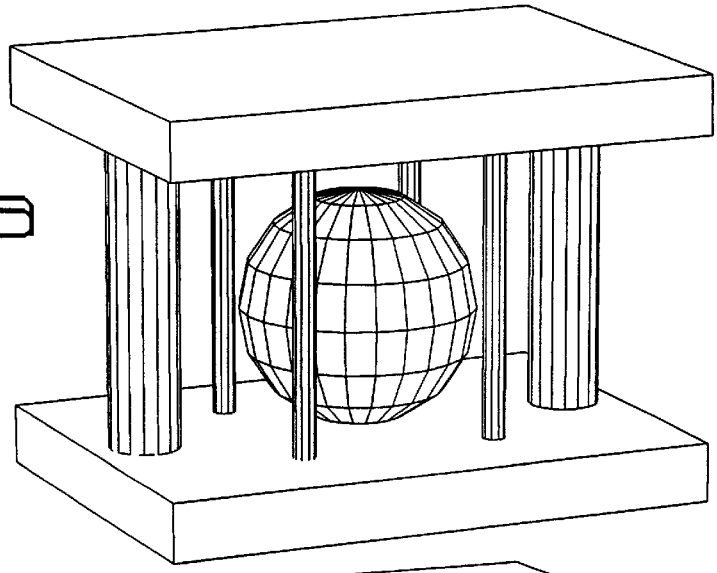

FIG. 20*a* is a perspective view of the puzzle as it appears when containing a ball.

Figure 20B:
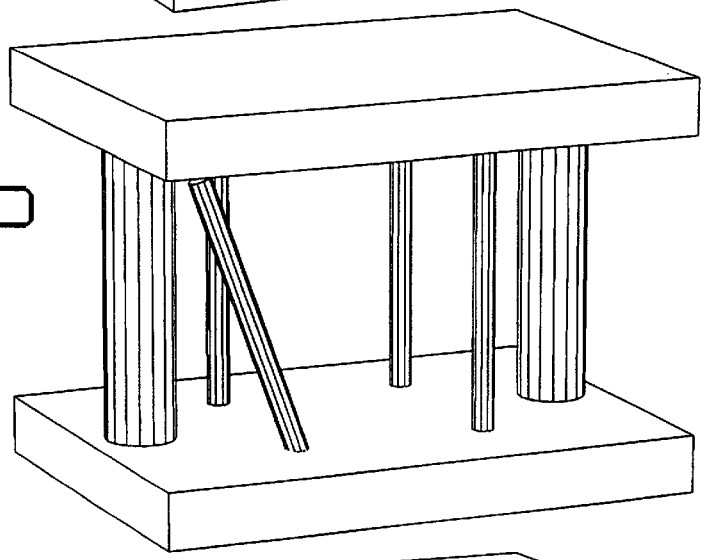

FIG. 20*b* is a perspective view of the puzzle as it appears with its release rod displaced and the ball removed.

Figure 20C:
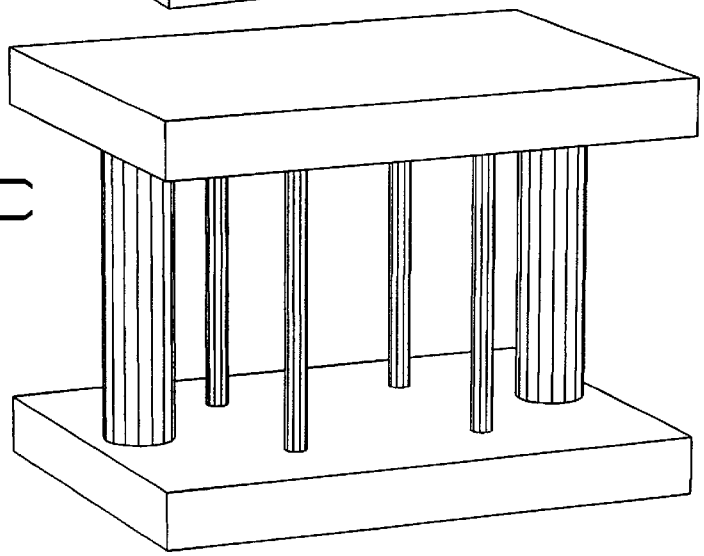

FIG. 20*c* is a perspective view of the puzzle as it appears when locked and empty.

Figure 21:
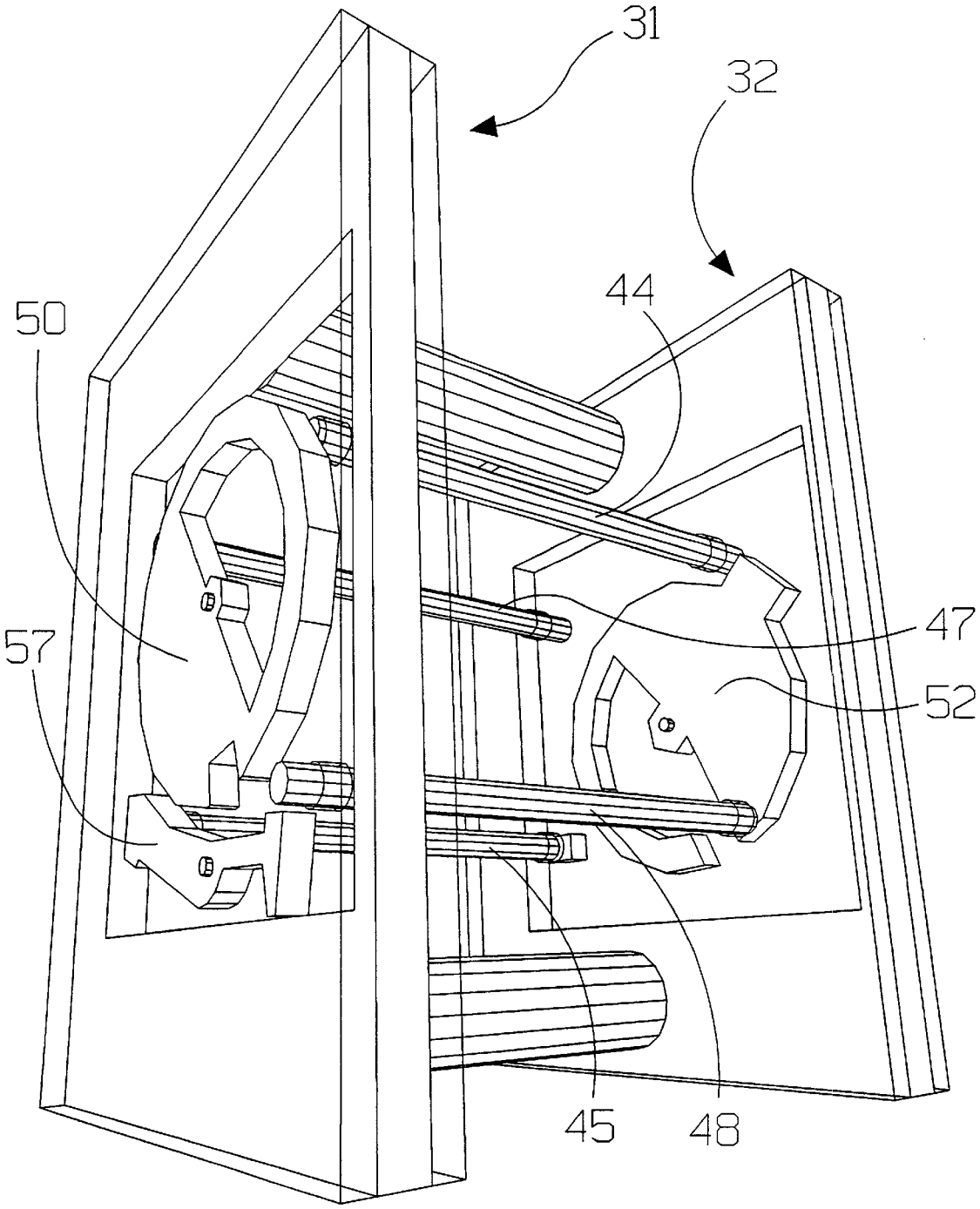

FIG. 21 is offered for use as accompaniment to the abstract, presenting a close proximity perspective view of the puzzle and its internal features.

LIST OF REFERENCE NUMERALS

| | |
|---|---|
| 31. | primary end cap |
| 32. | secondary end cap |
| 33. | a solid beam (rigid supporting member) |
| 34. | a solid beam (rigid supporting member) |
| 35a. | inner layer of primary end cap |
| 35b | inner layer of secondary end cap |
| 36a | middle layer of primary end cap |
| 36b | middle layer of secondary end cap |
| 37a | outer layer of primary end cap |
| 37b | outer layer of secondary end cap |
| 38a | rectangular void in middle layer of primary end cap |
| 38b | rectangular void in middle layer of secondary end cap |
| 39a | cavity within primary end cap |
| 39b | cavity within secondary end cap |
| 40a | a port in primary end cap |
| 40b | a port in secondary end cap |
| 41a | a port in primary end cap |
| 41b | a port in secondary end cap |
| 42a | a port in primary end cap |
| 42b | a port in secondary end cap |
| 43a | a port in primary end cap |
| 43b | a port in secondary end cap |
| 44 | a blocking rod |
| 45 | release rod |
| 46 | a passive rod |
| 47 | a passive rod |
| 48 | a blocking rod |
| 49 | primary pendulum axle |
| 50 | primary pendulum |
| 51 | primary pendulum slot |
| 52 | secondary pendulum |
| 53 | secondary pendulum axle |
| 54 | secondary pendulum slot |
| 55 | secondary pendulum tab |
| 56 | pad (bumper for release rod) |
| 57 | tertiary pendulum |
| 58 | tertiary pendulum axle |

DESCRIPTION OF THE INVENTION

Overview

To provide a clear understanding of the invention it will be advantageous to begin with a statement of its overall purpose: The cage puzzle herein described has been devised with the intention of providing amusement through stimulation of the curiosity and challenge to the intellect. The puzzle is designed in such a way as to be visually intriguing by virtue of its external appearance of stark simplicity, yet engineered internally in such a manner as to defy random or accidental discovery of its solution. Furthermore, it is designed so that its solution does not require jarring, striking or other forceful movements; instead, its solution requires nothing more than a subtle and gentle sequence of orientations with respect to gravity, the specific sequence easily executed within a time span of between three and five seconds. Such ease and speed of execution, when demonstrated, adds to the sense of curiosity and intrigue on the part of those who witness the feat.

Fundamental Structure

To embark on a description of the invention it will be good to consider, first of all, the basic framework, or solid structure, of the puzzle. It should be noted that, although the following description is based on a fully operational prototype constructed of acrylic plastic and stainless steel, a wide variety of other solid materials can be used with comparable success and effectiveness. It should also be noted that the overall size and dimensional proportions that may be specified in, or inferred from, the description are to be taken as workable examples, and can in fact be enlarged or diminished considerably without compromising the successful operation of the invention.

Figure 1:
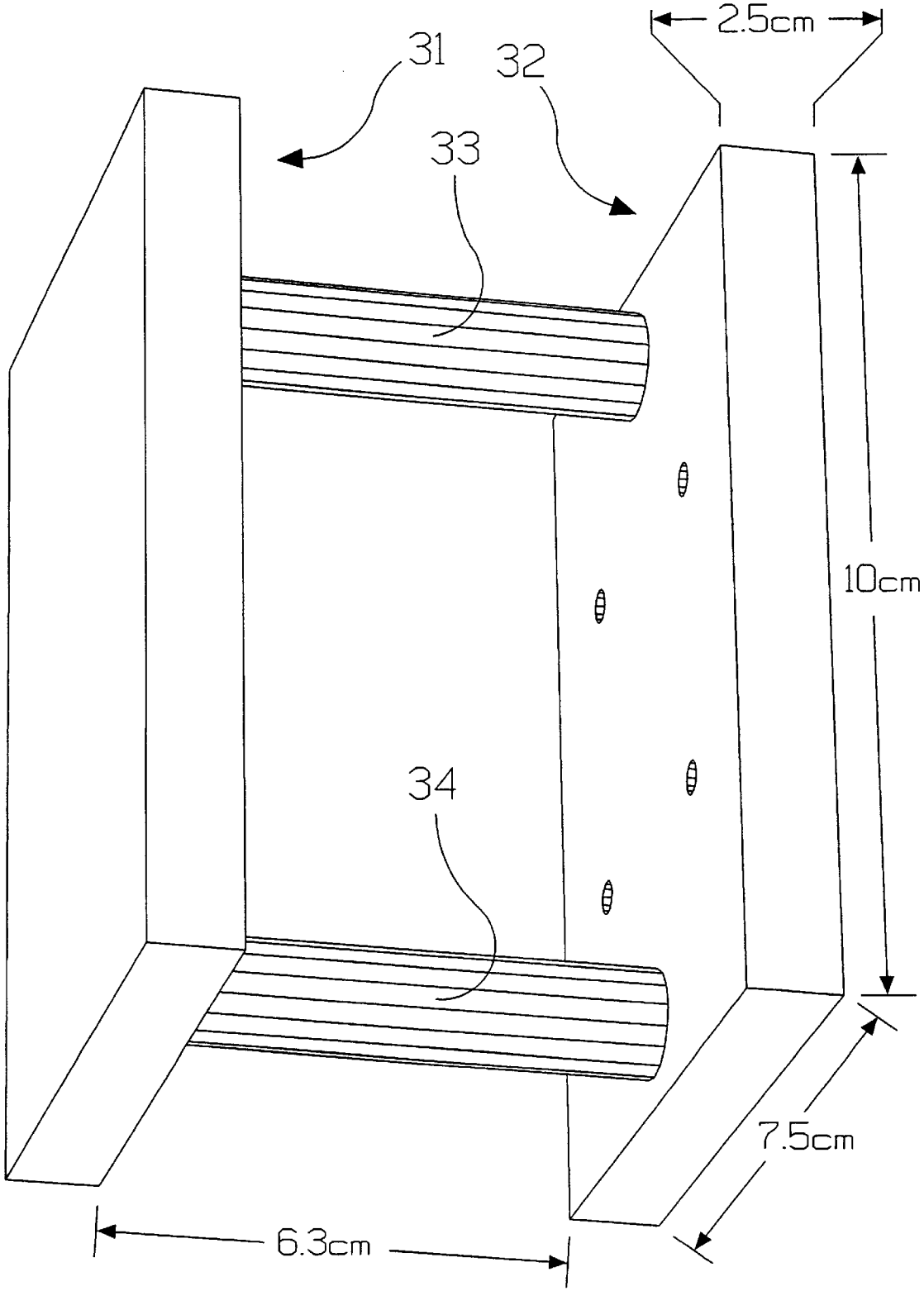
FIG. 1 is a perspective view of the rigid, fundamental structure, or framework, of the puzzle.

With reference to FIG. 1, it can be seen that the puzzle is based on a rigid structure comprising two rectangular planiform end caps 31 and 32, identical to each other with respect to their outer dimensions of 10 cm length by 7.5 cm width by 2.5 cm thickness. The two caps are connected to each other by two solid beams 33 and 34.

Figure 2:
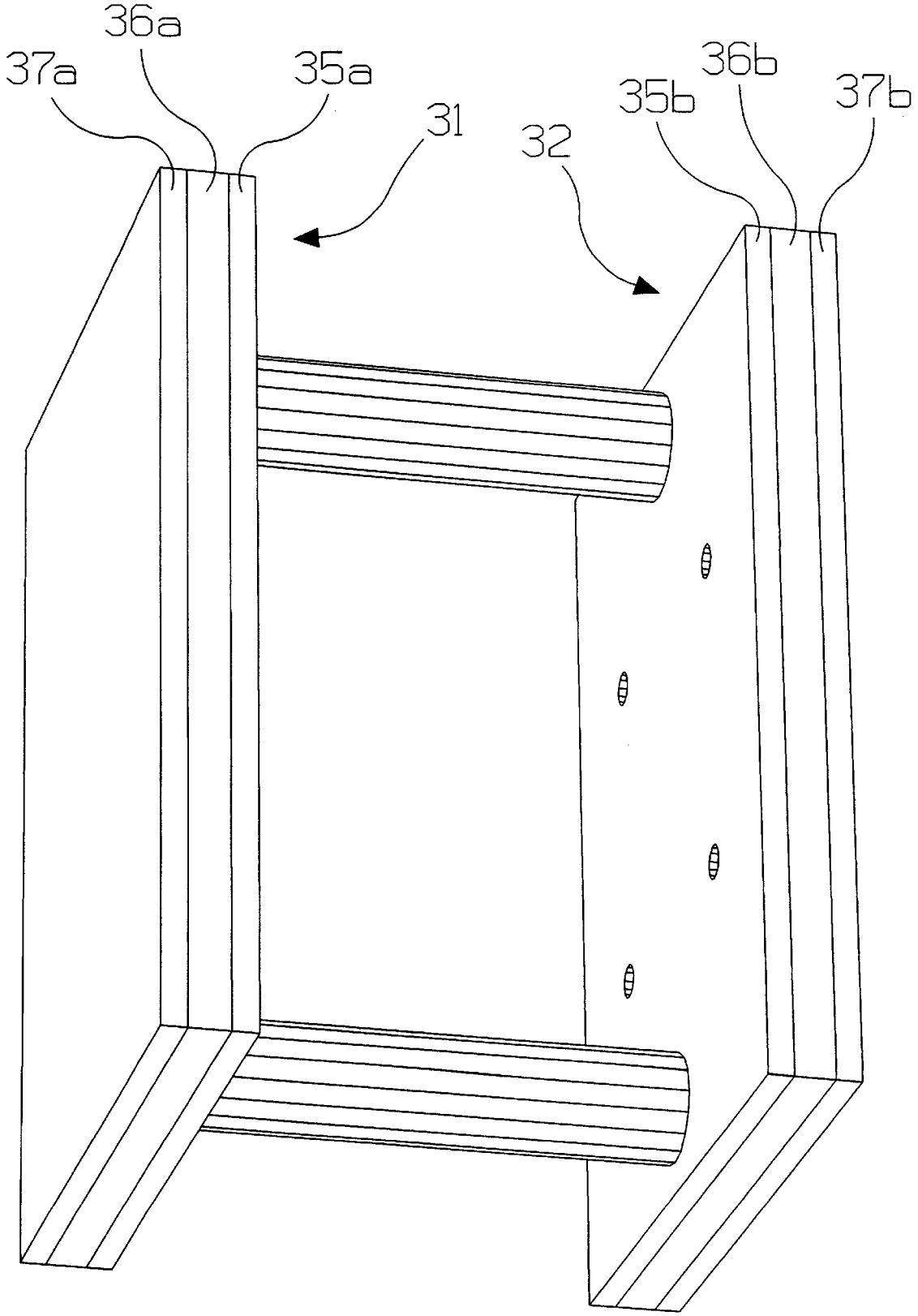
FIG. 2 is a perspective view showing how the puzzle's end caps can be considered laminous, and depicts the end caps as though composed of three layers.

For purposes of illustration, and with reference to FIG. 2, each end cap can be considered to be laminous, composed of three plates sandwiched together, such that end cap 31 comprises inner plate 35*a*, middle plate 36*a*, and outer plate 37*a*, and such that end cap 32 comprises inner plate 35*b*, middle plate 36*b*, and outer plate 37*b*.

Figure 3:
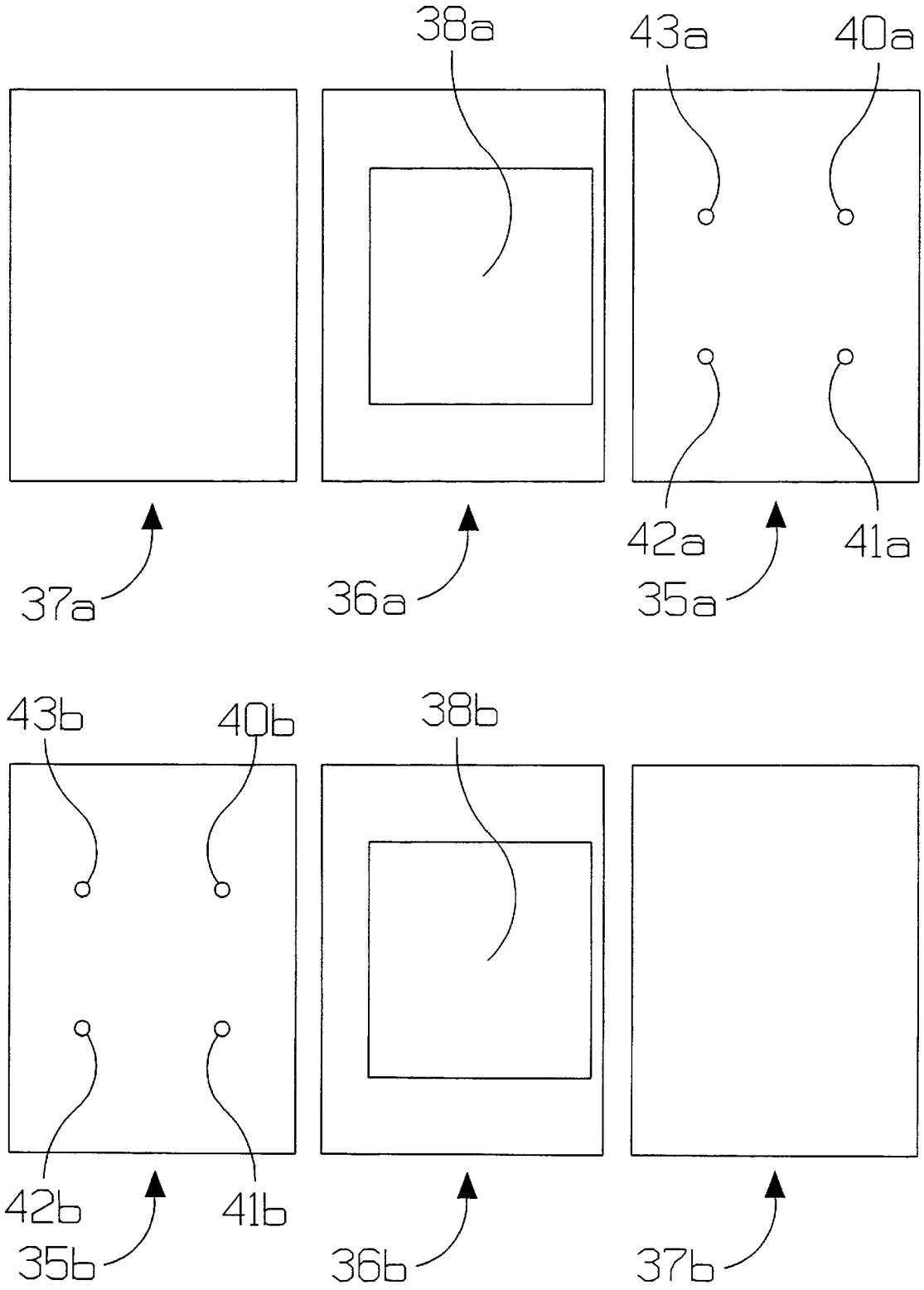
FIG. 3 is a plan view showing features of the above-mentioned end cap layers.
Figure 4:
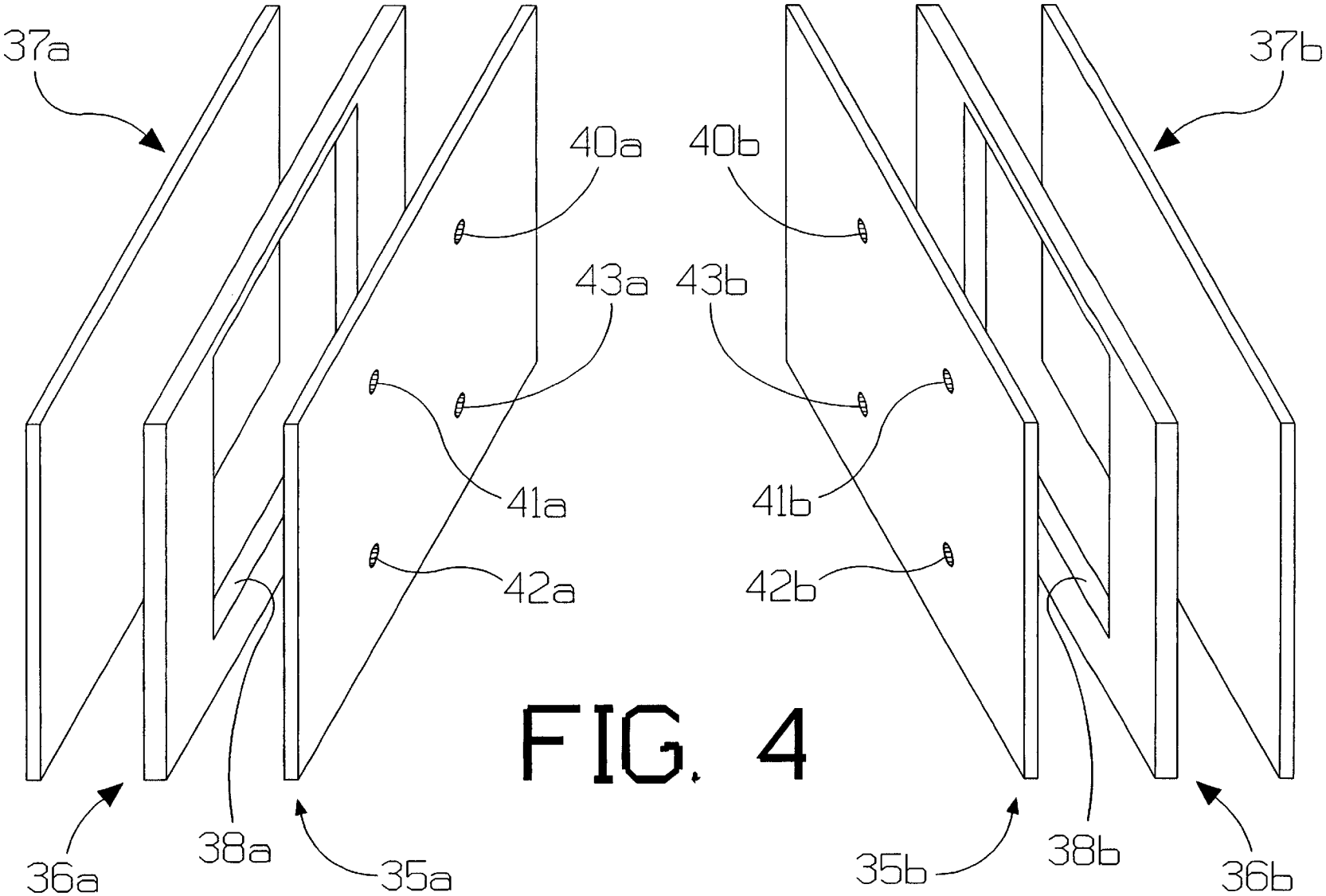
FIG. 4 is a perspective view showing the layers as they would align with each other in the process of stacking to form the end caps.
Figure 5:
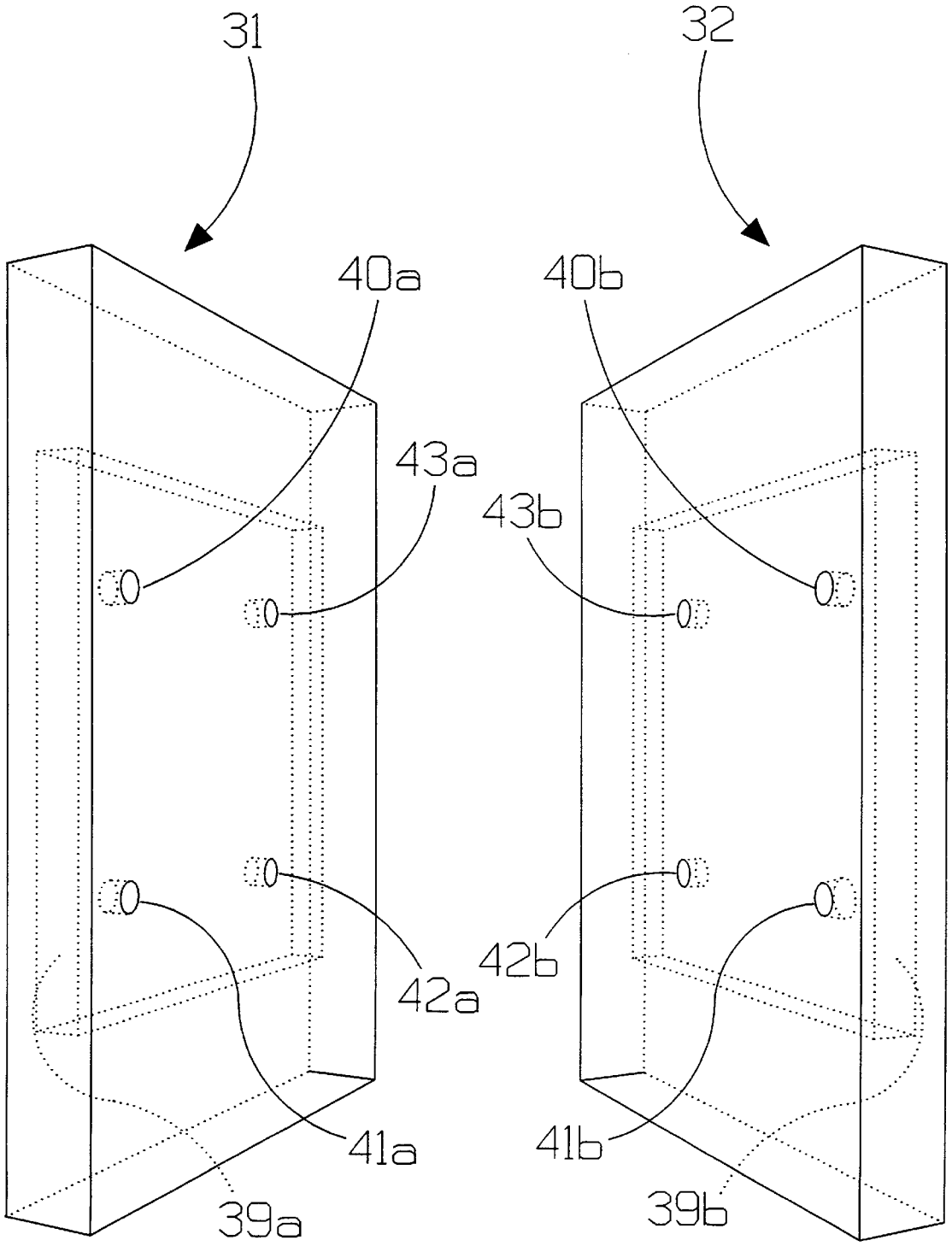
FIG. 5 is a perspective view showing in dotted lines the ports and internal cavities of the end caps.

In FIGS. 3 and 4, a plan view and an oblique view respectively, it can be seen that middle plates 36*a* and 36*b* have large rectangular voids 38*a* and 38*b* so that, when the middle plates are sandwiched between their respective inner and outer plates, there are resultant cavities 39*a* and 39*b* within the end caps thus formed as seen in FIG. 5, a perspective view of the two caps facing each other.

With further reference to FIG. 5 it can be seen that inner plate 35*a* of end cap 31 has four cylindrical holes, serving as ports 40*a*, 41*a*, 42*a* and 43*a*, arranged in a square pattern and extending perpendicularly through the plate. Directly opposite, on confronting inner plate 35*b* of end cap 32, a respectively congruent square pattern of similar holes, serving as ports 40*b*, 41*b*, 42*b* and 43*b*, can also be seen. Port 41*b* differs subtly from the other seven ports in that it widens slightly in diameter as it leads toward the cavity of end cap 32.

End caps 31 and 32 are aligned with each other, their confronting faces parallel, and separated from each other by a functional distance approximately five times the thickness of either end cap. The end caps are held firmly and permanently in such positional relation to each other by solid, cylindrical beams 33 and 34, which are each 6.3 cm in length, and which are attached securely between the confronting faces of the end caps, each beam serving as a rigid supporting member. The two beams, acting in concert at opposite sides of the puzzle, are of sufficient diameter and structural strength to rigidly maintain the spatial relationship of the two end caps with respect to each other, defying the typical twisting and flexing forces that are often applied by those who are frustrated in their attempts to solve the puzzle. Because they act as a rigid supporting member, holding the caps firmly in position, the two beams serve as part of the puzzle's enclosing structure.

The dimensional measurements above, relating to the end caps and supporting members, are offered for the purpose of providing a sense of the size and proportions of a working fundamental puzzle structure. For the sake of clarity and simplicity, smaller elements of the puzzle will be described sufficiently and shown pictorially to provide a thorough understanding of their form and function, their relative dimensions being evident by way of the drawings presented.

Figure 6:
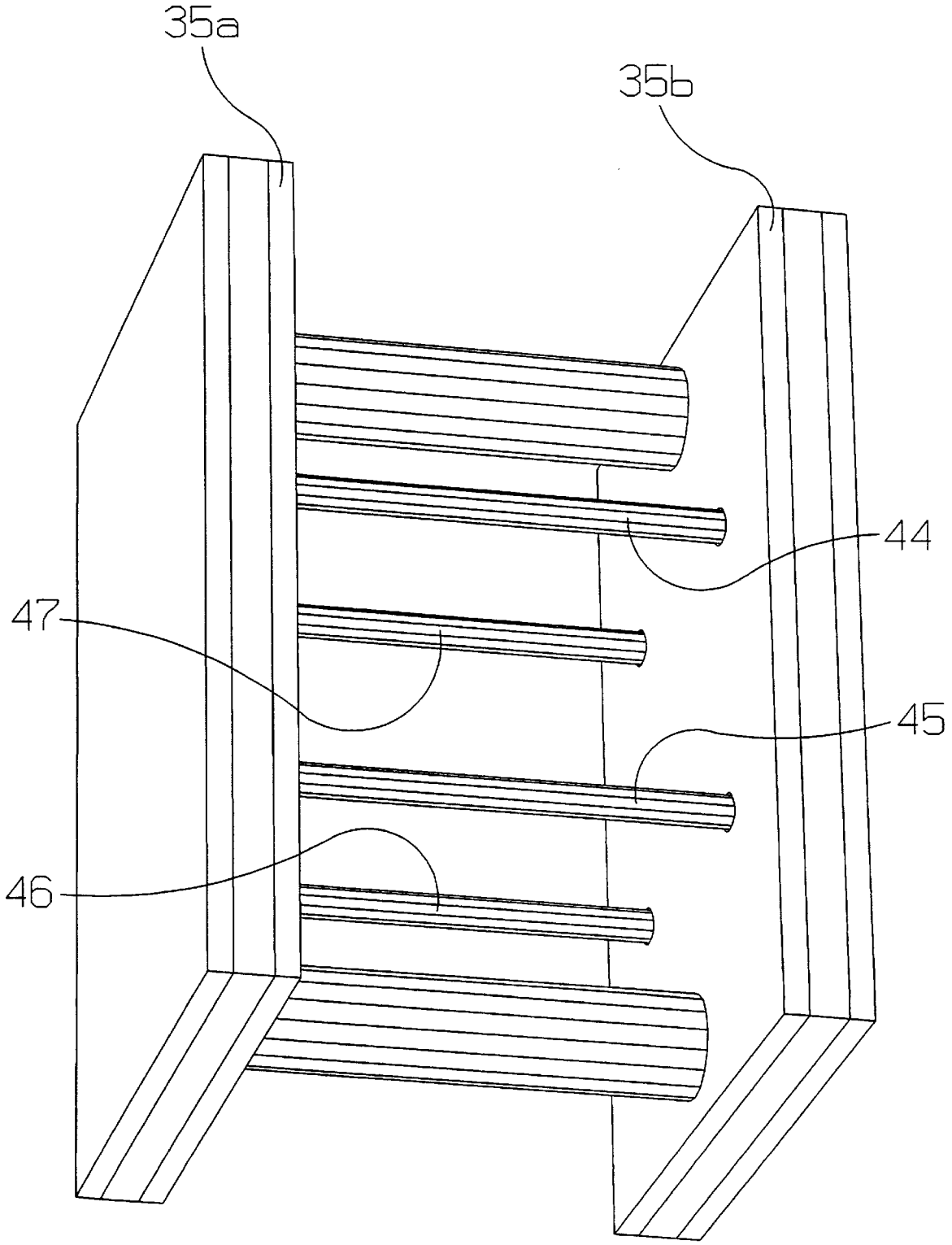
FIG. 6 is a perspective view of the puzzle structure with the addition of four rods that form a cage.

With reference shifting to FIG. 6, an exterior perspective view of the structure, it can be seen that the puzzle features a cage enclosure comprising four rods 44, 45, 46 and 47, the ends of which extend into the cavities of the end caps through the ports of inner plates 35*a* and 35*b*. Because they are of slightly larger diameter than the rods, the ports simply act as guides for the rods, rather than as anchors or fasteners, thereby allowing the rods to be rotated axially as well as slid back and forth longitudinally. Although the rods can be composed of virtually any solid material, they should be of sufficient diameter and strength as to resist bending or other malformation that might otherwise result from the impatient use of force.

The embodiments described herein utilize rods of stainless steel, resistant to corrosion and tarnishing that could otherwise occur as a result of acidic residues from handling and manipulation. Although the rods can be slid back and forth longitudinally, they are all of sufficient length so that in the puzzle's normally locked configuration no rod end can be slid out of its respective port.

FIRST EMBODIMENT

To provide an understanding of the internal mechanism of the puzzle, reference will now be made to FIGS. 7 and 8, close proximity perspective views of the first embodiment showing the interiors of end caps 31 and 32. In these figures, and all subsequent figures presenting perspective views of the interior features, the inner and outer plates of the end caps are portrayed in wireframe style, thus rendering them transparent to facilitate the views. Attached to the inside surface of outer plate 37*a* by way of a small axle 49 is a free-wheeling rotoform primary pendulum 50 with an open slot 51 of somewhat greater width than the diameter of the rods, the slot being located at the pendulum's periphery, as can be seen with brief reference to FIG. 9, a perspective view showing this pendulum and others to be discussed later. A large, somewhat semicircular portion of the pendulum has been removed, leaving behind a void that serves to permanently shift the pendulum's center of mass so that, when allowed full freedom of rotation, the pendulum will tend to seek a particular orientation with respect to gravity.

The location of axle 49, in other words the pendulum's center of rotation, is such that the pendulum's peripheral slot 51 can share alignment with, and accept penetration of, the proximal end of rod 44 when the entire puzzle is oriented properly about the pendulum. Thus, primary pendulum 50 serves as a gate, either accepting or denying maximum penetration of rod 44, depending on the puzzle's orientation. As will be seen, this pendulum serves as the primary element of a sequential gating arrangement. It should be noted that, because the heaviest portion of the freewheeling pendulum always tends to point downward, it is the entire cage puzzle, itself, that must be rotated about the pendulum to bring the end of rod 44 into alignment with slot 51 for maximum rod penetration to take place. It is also important to note that this rotoform pendulum can only freewheel effectively when its plane of rotation is relatively vertical, as depicted in FIGS. 7 and 8, so that its surface does not rest upon, and thereby drag against, the interior surface of either outer plate 37*a* or inner plate 35*a*, both of which constitute the two major interior walls of the cavity of end cap 31. Furthermore, to ensure the pendulum's freedom of movement during the process of solving the puzzle, rod 44 should be slid longitudinally away from the pendulum, thus providing clearance between the end of the rod and the face of the pendulum.

With attention turning to the interior of end cap 32 a secondary pendulum 52 can be seen attached to the inner surface of outer plate 37*b* by way of a small axle 53. This pendulum, the secondary element of the sequential gating arrangement, is also of a freewheeling rotoform type and features not only a slot 54 whose width at the periphery of the pendulum is similar to that of slot 51, but also a tab 55 extending outward from another location on the pendulum's periphery.

With another brief reference to FIG. 9, it can be seen that, after having progressed a short distance inward from the periphery, slot 54 widens to become a somewhat semicircular void within secondary pendulum 52, thereby resulting in a shift of the pendulum's center of mass away from its axis of rotation so that, when allowed freedom of rotation in a vertical plane, the pendulum will seek a particular orientation with respect to gravity in a manner similar to that of primary pendulum 50.

OPERATION

As shown in FIGS. 7 and 8, when rod 44 is disposed in such a way that it has not penetrated slot 51 of primary pendulum 50 its length is such that it has a small, but noticeable, amount of longitudinal end play, equating to approximately half the thickness of either pendulum, the rod thus being able to be slid back and forth, abutting at one end the surface of primary pendulum 50 or at the other end the inner surface of outer plate 37*b* of end cap 32. It is important to note that in this configuration the amount of such end play is insufficient to allow passage of tab 55 between the inner surface of outer plate 37*b* and the proximal end of rod 44. As measured from the center of rotation of secondary pendulum 52 it can be seen that the angular separation between tab 55 and slot 54 is such that slot 54 cannot share alignment with rod 45 as long as tab 55 is restricted from interposing between the proximal end of rod 44 and the inner surface of plate 37*b*.

However, as can be seen in the perspective views of FIGS. 10 and 11, close proximity internal and external perspective views, once the puzzle has been rotated to an orientation that brings rod 44 into alignment with slot 51 of primary pendulum 50 one can then slide the rod so that its end passes through the slot and abuts the inner surface of plate 37*a*.

The above having been accomplished, ample clearance within end cap 32 is created between the opposite end of rod 44 and the inner surface of plate 37*b* to accommodate the interposition of tab 55. Therefore, by canting the puzzle slightly to one side to ensure that the end of rod 44 remains resting against the inner surface of plate 37*a*, one can proceed to rotate the puzzle to the next proper position, or attitude, whereby rod 45 will come into alignment with slot 54 of secondary pendulum 52. Such alignment having been achieved, rod 45 can then be slid farther into the cavity of end cap 32, passing through slot 54, so that its end abuts the inner surface of outer plate 37*b*. Because rod 46 is somewhat shorter than the other rods, its other end pulls free of port 41*a* when the rod is slid to its fullest longitudinal extent into end cap 32.

Freed from the constricting guidance of port 41*a*, rod 45 can now be gently angled away from the other rods, as shown in FIGS. 12 and 13, such angling facilitated by the fact that port 41*b* is less restrictive in guidance than the other ports due to its widened diameter. The angular displacement of rod 45 provides a widening, or enlarged passageway, for accommodating the insertion or extraction of a solid object into or out of the cage enclosure. Because it is released from port 41*a*, then subsequently displaced to allow release of an object that might otherwise remain confined within the puzzle, rod 45 can rightly be referred to as a release rod, while rod 44, the first to be engaged in the puzzle's solution sequence, and which in its normal disposition blocks passage of tab 55, can properly be referred to as a primary blocking rod.

At this juncture, and with reference to those figures depicting the puzzle's interior, there is one other small point that should be brought out, for it is quite helpful and certainly worthy of mention to one who would endeavor to construct this cage puzzle: Because rod 45 is in fact shorter than the other rods, it is necessary to include some form of bumper, in this case a hard pad 56, located on the inner surface of outer plate 37*a* of end cap 31, against which the end of the rod can strike. This pad, being of the same thickness of either pendulum, prevents rod 45 from moving so deeply into end cap 1 as to cause the rod to pull free of port 41*b* of end cap 32.

With the elements of this cage puzzle and their operation having thus been described it can be seen that rotoform pendulums 50 and 52 serve together as a sequential gating arrangement, operating in conjunction with each other via rod 44, the blocking rod. This unique arrangement virtually eliminates the likelihood of accidental or serendipitous solution, for this puzzle, by way of its highly responsive sequential gating, requires a precise and specific series of motions and orientations to achieve release.

Closing the cage and restoring it to its locked configuration is simply a matter of reinserting the free end of rod 45 into port 41*a*, and then rotating the puzzle through several random attitudes, thereby allowing rods 44 and 45 to withdraw from the pendulum slots, and thereby also allowing the two pendulums to freewheel once again.

PREFERRED EMBODIMENT

In one sense it can be said that a "puzzle" remains a "puzzle" only as long as its solution remains undiscovered. Therefore, with the purpose of providing a cage puzzle that promises to challenge the aspiring solver over a greater period of time, the following enhanced embodiment is preferred:

FIGS. 14 and 15 are perspective views showing the cage puzzle as depicted earlier, but with several changes having been made as follows: Firstly, pad 56 has been relocated to a point on the inner surface of outer plate 37*b* of end cap 32 such that the pad is in alignment with port 42*b*.

Secondly, rod 46 has been replaced by release rod 45 such that its ends thereby extend into ports 42*a* and 42*b*, port 42*a* now having a slightly enlarged diameter to allow angular displacement of the release rod.

Thirdly, rod 48, a secondary blocking rod having the same length as that of primary blocking rod 44, has been introduced and placed in the position formerly held by release rod 45, the ends of rod 48 now extending into ports 41*a* and 41*b*. This secondary blocking rod 48 is now able to perform a blocking function similar to that of primary blocking rod 44, but in this case rod 48 operates in conjunction with secondary pendulum 52 and a newly added third element in an expanded sequential gating arrangement. This new element can be seen within end cap 31 in the form of a tertiary pendulum 57 attached to the inner surface of outer plate 37*a* by way of axle 58. The pendulum has in this case a narrow range of motion to accommodate space considerations.

In this embodiment tertiary pendulum 57, seen also in closer detail with brief reference to FIG. 9, has the appearance of, and functions in a way similar to, a rocker arm whose center of mass is displaced from its axis of rotation so that, when free to pivot, its disposition within end cap 31 is dependent upon the puzzle's orientation with respect to gravity. It should be noted, however, that under normal circumstances the pendulum is restricted from pivoting because of the blocking effect of rod 48, whose minimal amount of end play against the inner surface of outer plate 37*a* leaves insufficient clearance to permit passage of the pendulum's shorter and less massive arm. While thus restricted, the pendulum's shape and location within the cavity of end cap 31 are such that its longer and more massive arm interposes between the proximal end of release rod 45 and the inner surface of outer plate 37*a*.

OPERATION

With reference to FIG. 16, if rod 48 is successfully moved into slot 54 of secondary pendulum 52, as was rod 45 in the earlier description of the first embodiment, ample clearance is thereby created that allows the shorter arm of tertiary pendulum 57 to pass between the proximal end of rod 48 and the inner surface of outer plate 37*a*, as seen in FIG. 17. With the pendulum's freedom of movement thus obtained, the puzzle can then be rotated to a new orientation that allows the longer, heavier arm of the pendulum to move downward and out of the way of rod 45 so that the rod can thus be slipped to its fullest extent into end cap 31, thereby pulling free of port 42*b* of end cap 32. As a result the rod can then be angularly displaced a sufficient amount, as shown in FIGS. 18 and 19, to permit the extraction or insertion of a solid object that would otherwise not be able to pass between the enclosing rods.

The procedure for closing the cage and restoring it to its locked configuration is much like that used in the first embodiment. In this instance it involves re-inserting the free end of rod 45 into port 42*b*, inverting the puzzle to flip tertiary pendulum 57 back to its normally locked position, then rotating the puzzle through several random attitudes. In this embodiment, as well as in the first, rod 47 is not an element of the sequential gating means, but simply serves the singular function of acting as one of the enclosing rods of the four-rod cage. Hence, rod 47 can be referred to as a passive rod.

In bringing this description to its conclusion, FIG. 20 is offered as a simple pictorial summary taken from an exterior viewpoint. Displayed are the three configurations of the puzzle as they occur in the sequence of solution. In the first depiction of the series the puzzle contains an object within the confines of its cage-like enclosure, the object in this example being a ball too large to be extracted. The second depiction shows the puzzle in its released configuration as described earlier, such configuration having allowed the extraction of the object. The third depiction shows the puzzle as it has been restored to its locked configuration.

SUMMARY

By way of the description above it can be seen that this invention is a cage puzzle of unique and highly efficient design, wherein both the cage and its sequential gating arrangement are actually integrated, each being a part of the other. In the preferred embodiment this is readily evident by the fact that two of the cage rods serve not only to enclose an object, but also to interact between the primary and secondary pendulums as well as between the secondary and tertiary pendulums, such interaction being an integral aspect of the sequential gating process that takes place within. By virtue of its exterior simplicity as well as its reliable, attitude-responsive internal design this puzzle can be unlocked within three to four seconds, once the procedure is understood and implemented.

Upon review of the foregoing description it us clear that the present invention indeed achieves the objects and yields the advantages earlier set forth, specifically, A. To provide a cage puzzle of notable internal sophistication, yet whose outward appearance is remarkably simple, with the resultant advantage that, rather than appearing intimidating, daunting, or overwhelming in complexity, the puzzle will instead be seen as attractive and enticing to the curiosity.

B. To provide a cage puzzle whose solution will neither be discovered easily nor by accident, the resultant advantage being that the puzzle will maintain its aspects of challenge and intrigue for a considerable time.

C. To provide a cage puzzle whose multiple step solution, once known, can be executed easily and within a time duration of less than five seconds, the advantage being that the puzzle can be demonstrated before onlookers in such a way as to not only heighten existing senses of curiosity, mystery and wonder, but also to prove beyond doubt that the puzzle can indeed be solved.

D. To provide a cage puzzle whose solution requires neither forceful manipulation nor striking, with the result that the puzzle's degree of mystery and intrigue is even further enhanced.

E. To provide a cage puzzle whose function is neither reliant upon nor vulnerable to any magnetic influence, whether of internal or external origin, the advantage being that the puzzle can be constructed of virtually any solid material, some examples of which not only include woods, plastics and ceramics, but also both ferrous and nonferrous metals.

F. To provide a cage puzzle whose mechanism is both reliable and consistent in its operation, with the resultant advantage that the puzzle can be locked and unlocked smoothly and effortlessly and without embarrassing or awkward malfunctions when being demonstrated before onlookers.

G. To provide a cage puzzle that allows an enclosed object to be plainly and easily visible, thereby generating increased curiosity and a heightened desire on the part of the aspiring solver to remove such an object.

H. To provide a cage puzzle whose operative rods are all visible and directly moveable by hand, thereby giving the aspiring solver a greater sense of participation and control.

I. To provide a cage puzzle that maximizes the functionality of the enclosing rods, causing them to serve not only their obvious function of restricting the passage of an object between them, but also the less obvious function of acting as elements in the keying process that ultimately releases such restriction. The advantage of such dual function is that of providing, without the addition of complexity to its outward appearance, a puzzle of hidden elegance and sophistication which promises to present a formidable challenge to anyone who would endeavor to discover its solution.

SCOPE AND RAMIFICATIONS

Although the foregoing description contains many specificities relating to both the method of construction and the procedures of operation of the cage puzzle, these should not be construed as limiting the scope of the invention. Such specificities should rather be understood as merely providing illustration of two suggested embodiments. For purposes of clarity each end cap has been described as though it were composed of three laminations, when in fact each cap can also be fashioned as a single component composed, for example, of injection-molded plastic.

The preferred embodiment, utilizing three pendulums, has proven itself extremely effective over a testing period of eleven months, thwarting even the most intense efforts by more than a hundred puzzle enthusiasts, some spending in excess of ten hours in their attempts. No one, up to the time of this writing, has solved the puzzle, and neither its design nor its solution has been disclosed. For this reason the three-pendulum embodiment is preferred for its efficacy in defying solution as well as its simplicity of design. By incorporating a fourth pendulum, similar to the tertiary pendulum described, the passive rod and release rod of the preferred embodiment could be juxtaposed, the passive rod then assuming the function of a tertiary blocking rod operating in conjunction with such a fourth pendulum to key the release rod. Although it would be relatively easy and inexpensive to add such a heightened level of complexity, the enhancement does not appear warranted at this juncture, for the preferred embodiment presents ample resistance to solution in its present form.

It should be noted that the present invention is a cage-like enclosure puzzle capable of enclosing an object such as a ball, an egg, a figurine, or any solid object whose dimensions would be suitable for such enclosure. Although it is anticipated that a ball, because of its geometric simplicity, will be the most common object chosen for enclosure, the puzzle as claimed does not include a ball, nor any other object to be enclosed, as an element of the invention.

For purposes of design simplicity and ease of construction the present invention has been described as including not only rectangular end caps, but also four rods, arranged in a square pattern, that serve together as the cage enclosure, such arrangement being naturally suitable to an environment in which right angles and rectangular objects tend to prevail when consideration is given to packaging, shipping and storage. It should be noted, however, that the puzzle can be constructed in a way that utilizes a greater, or lesser, number of rods. For example, it could be made in such a way as to include only three rods, the end caps taking a triangular, rather than rectangular, form. Conversely, the puzzle could also be made to include five or more rods, and could even incorporate a greater number of pendulums to increase its complexity.

Although non-cylindrical rods could be employed in conjunction with accommodating non-cylindrical ports, there are two inherent and obvious advantages in using cylindrical rods: First of all, they are the simplest in terms of geometry and appearance; secondly, they can be rotated axially between the fingers with the result that the aspiring puzzle solver may either conclude that the rods are independent and passive elements, or suspect that a particular sequence of rod twists will lead to a successful solution, neither conclusion or suspicion being correct.

It should also be noted that virtually any functionally rigid structure could serve as the rigid supporting member for maintaining the positional relationship of the end caps with respect to each other. Although a cylindrical beam style has been chosen for considerations of aesthetics, such a beam might just as easily have a triangular, square, elliptic or other cross section. On the other hand, the sturdy supporting S member could also be a thick plate or angled wall mounted between the caps, as long as the rigid supporting function is achieved.

The present invention, although intended primarily for purposes of amusement and mental stimulation, could also be used in other fields of endeavor. For instance, in the fields of marketing and promotion the invention could serve as a special packaging or display device to draw attention to an article of merchandise enclosed within.

Such variations and ramifications having been mentioned, the scope of the invention should be ascertained by the appended claims and their legal equivalents, rather than by the examples given.

The invention having been described, I hereby claim:

1. A puzzle comprising:

two end caps, namely a primary end cap and a secondary end cap, aligned in opposition to each other such that their confronting faces are separated from each other to create an intervening space, each end cap including not only a cavity within, but also two ports communicating with said cavity and openly terminating at the confronting face, and an enclosing structure for connecting said primary and secondary end caps in such a way as to rigidly maintain their positional relationship with respect to each other; and for accepting, excluding, retaining and releasing an object of appropriate size that might be placed within its confines, said enclosing structure including a rigid supporting member mounted between and connecting the end caps a primary blocking rod and a release rod spaced and aligned appropriately to cooperate with the primary and secondary end caps to prevent escape of an object so placed, the two rods extending between and partially penetrating the end caps by way of said ports, the ports being in such alignment with each other and the release rod being of such appropriate length that, when it is slid longitudinally so as to cause one of its ends to penetrate the secondary end cap to the maximum extent possible, the opposite end of the rod emerges from its respective port in the primary end cap, and a sequential gating means for alternately permitting and preventing maximum end cap penetration by said primary blocking rod and the release rod, said gating means being responsive to attitudinal orientation with respect to gravity and comprising a primary pendulum disposed within the cavity of the primary end cap and a secondary pendulum disposed within the cavity of the secondary end cap, the freedom of rotation of said secondary pendulum being either restricted or permitted by the primary blocking rod as a result of the rod's longitudinal disposition, such disposition in turn being dependent on the rotational orientation of said primary pendulum such that, when the puzzle is positioned in a particular attitudinal orientation with respect to gravity, the primary pendulum will then allow the primary blocking rod to achieve maximum penetration of the primary end cap and to thereby retract somewhat from the secondary end cap, thus granting full freedom of rotation to the secondary pendulum such that, when the puzzle is repositioned to yet another specific attitudinal orientation, the secondary pendulum will allow the release rod to achieve maximum penetration of the secondary end cap, such that one end of the release rod pulls clear of the primary end cap with the result that the release rod can then be angularly displaced to provide a widened passage for accommodating the insertion or retraction of an object into or out of the puzzle.

2. A puzzle according to claim 1 further including a passive rod, and whereby each end cap further includes a third port communicating with the end cap cavity and openly terminating at the confronting face, said passive rod being similar in appearance to the two other rods and extending between and partially penetrating the end caps by way of their said third ports, such that the passive rod, while having no active function with regard to the operation of the sequential gating means, yet serves as an additional participating element of the enclosing structure.

3. A puzzle according to claim 2 further including a second passive rod, and whereby each end cap further includes a fourth port communicating with the end cap cavity and openly terminating at the confronting face, said second passive rod being similar in appearance to the three other rods and extending between and partially penetrating the end caps by way of their said fourth ports, such that the passive rod, while having no active function with regard to the operation of the sequential gating means, yet serves as an additional participating element of the enclosing structure.

4. A puzzle comprising:

two end caps, namely a primary end cap and a secondary end cap, aligned in opposition to each other such that their confronting faces are separated from each other to create an intervening space, each end cap including not only a cavity within, but also three ports communicating with said cavity and openly terminating at the confronting face, and an enclosing structure for connecting said primary and secondary end caps in such a way as to rigidly maintain their positional relationship with respect to each other; and for accepting, excluding, retaining and releasing an object of appropriate size that might be placed within its confines, said enclosing structure including a rigid supporting member mounted between and connecting the end caps, three rods, namely a primary blocking rod, a secondary blocking rod, and a release rod, spaced and aligned appropriately to cooperate with the primary and secondary end caps to prevent escape of an object so placed, said three rods extending between is and partially penetrating the end caps by way of said ports, the ports being in such alignment with each other and said release rod being of such appropriate length that, when it is slid longitudinally so as to cause one of its ends to penetrate the primary end cap to the maximum extent possible, the opposite end of the rod emerges from its respective port in the secondary end cap, and a sequential gating means for alternately permitting and preventing maximum end cap penetration by said primary blocking rod, said secondary blocking rod, and the release rod, said gating means being responsive to attitudinal orientation with respect to gravity and comprising both a primary pendulum and a tertiary pendulum disposed within the cavity of the primary end cap and a secondary pendulum disposed within the cavity of the secondary end cap, the freedom of rotation of said secondary pendulum being either restricted or permitted by the primary blocking rod as a result of the rod's longitudinal disposition, such disposition in turn being dependent on the rotational orientation of said primary pendulum such that, when the puzzle is positioned in a particular attitudinal orientation with respect to gravity, the primary pendulum will then allow the primary blocking rod to achieve maximum penetration of the primary end cap and to thereby retract somewhat from the secondary end cap, thus granting full freedom of rotation to the secondary pendulum such that, when the puzzle is repositioned to a second particular attitudinal orientation, the secondary pendulum will allow one end of the secondary blocking rod to achieve maximum penetration of the secondary end cap, causing the other end of the secondary blocking rod to retract somewhat from the cavity of the primary end cap, thereby creating rotational clearance for said tertiary pendulum so that, when the puzzle is maneuvered to yet a third particular attitude with respect to gravity, the tertiary pendulum will rotate to an orientation that allows one end of the release rod to achieve maximum penetration of the primary end cap as its other end pulls clear of the secondary end cap, the result being that the release rod can then be angularly displaced to provide a widened passage for accommodating the insertion or retraction of an object into or out of the puzzle.

5. A puzzle according to claim 4, whereby the enclosing structure further includes: a passive rod, each end cap including a fourth port communicating with the end cap cavity and openly terminating at the confronting face, said passive rod being similar in appearance to the three other rods and extending between and partially penetrating the end caps by way of their said fourth ports, such that the passive rod, while having no active function with regard to the operation of the sequential gating means, yet serves as an additional participating element of the enclosing structure.

* * * * *